US005176993A

United States Patent [19]

Ohshima

[11] Patent Number: 5,176,993

[45] Date of Patent: Jan. 5, 1993

[54] SILVER HALIDE PHOTOGRAPHIC MATERIAL

[75] Inventor: Naoto Ohshima, Minami-ashigara, Japan

[73] Assignee: Fuji Photo Film Co., Ltd., Kanagawa, Japan

[21] Appl. No.: 585,961

[22] Filed: Sep. 21, 1990

[30] Foreign Application Priority Data

Oct. 6, 1989 [JP] Japan ..... 1-261460

[51] Int. Cl.[5] ..... G03C 1/00; G03C 1/20

[52] U.S. Cl. ..... 430/584; 430/567; 430/569; 430/613; 430/607; 430/611

[58] Field of Search ..... 430/584, 567, 569, 613, 430/611, 607

[56] References Cited

U.S. PATENT DOCUMENTS

| | | | |
|---|---|---|---|
| 4,198,240 | 4/1980 | Mikawa | 430/570 |
| 4,717,650 | 1/1988 | Ikeda et al. | 430/584 |
| 4,839,263 | 6/1989 | Miyoshi et al. | 430/963 |

FOREIGN PATENT DOCUMENTS

| | | | |
|---|---|---|---|
| 0313021 | 4/1989 | European Pat. Off. . | |
| 0348934 | 1/1990 | European Pat. Off. . | |
| 0369491 | 5/1990 | European Pat. Off. . | |
| 0001019 | 1/1979 | Japan | 430/611 |
| 603187 | 6/1948 | United Kingdom | 430/611 |

*Primary Examiner*—Charles L. Bowers, Jr.
*Assistant Examiner*—Thorl Chea
*Attorney, Agent, or Firm*—Burns, Doane, Swecker & Mathis

[57] ABSTRACT

There is disclosed a silver halide photographic material comprising a photosensitive emulsion layer containing a nitrogen-containing heterocyclic compound and a silver halide emulsion of high-silver-chloride, which emulsion has been spectrally sensitized with a red-sensitive sensitizing dye having a definite reduction potential value, and which has been subjected to reduction sensitization. The disclosure as described provides a silver halide photographic material that is excellent in rapid processing and high in sensitivity and wherein there is little change of photographic performance.

16 Claims, No Drawings

SILVER HALIDE PHOTOGRAPHIC MATERIAL

FIELD OF THE INVENTION

The present invention relates to a silver halide photographic material, and more particularly to a silver halide photographic material that is excellent in rapid processability and high in sensitivity, and wherein there is little change of the photographic performance due to the passage of time or a change in the interval from exposure to processing.

BACKGROUND OF THE INVENTION

Silver halide photographic materials now commercially available and processes for forming images using them range widely, and are used in many fields. In many cases, the halogen compositions of the silver halide emulsions used in these many photographic materials are silver bromoiodide, silver bromochloroiodide, or silver chlorobromide, mainly comprising silver bromide to attain high sensitivity.

On the other hand, in products used in the market where there is strong demand for a large amount of prints to be finished in a short delivery time, such as photographic materials for color papers, silver bromide or silver chlorobromide substantially free from silver iodide is used due to the need to increase the speed of development.

In recent years there has been increasing demand to improve the rapid processability of color papers, and many studies are being carried out. It is well known that when the content of silver chloride of the silver halide emulsion used is increased, the rate of development is greatly improved.

On the other hand, in the conventional production of silver halide photographic materials, a technique is well known in which a sensitizing dye is added to a silver halide emulsion, to optically sensitize it and expand its photosensitive wavelength range.

Many compounds are conventionally known as spectrally sensitizing dyes used for such purpose, for example cyanine dyes, merocyanine dyes, xanthene dyes, etc., described by T. H. James in *The Theory of the Photographic Process,* Vol. 3 (1966, Macmillan, N.Y.), pages 198 to 228.

Generally when these sensitizing dyes are applied to silver halide emulsions, in addition to expanding the photosensitive wavelength range, they must also satisfy the following conditions:

(1) The spectrally sensitized range is proper.

(2) The sensitization efficiency is good, and sufficiently high sensitivity can be obtained.

(3) Fogging should not be brought about.

(4) It is narrow in scattering of the sensitivity due to a change of temperature during exposure, due to the interval from exposure to light to processing, or due to the passage of time before use.

(5) It must be free from any adverse interaction with other additives, such as stabilizers, antifoggants, coating aids, and couplers.

(6) When the silver halide emulsion containing the sensitizing dye is stored, in particular at a high temperature under high humidity, the sensitivity must not drop.

(7) Turbidity of colors (mixing of colors) after the development processing due to diffusion of the added sensitizing dye into other photosensitive layers must not take place.

The above conditions have important significance, particularly in the preparation of red-sensitive silver halide emulsions in silver halide color photographic materials.

However, when a silver halide emulsion high in silver chloride content is spectrally sensitized with a red-sensitive sensitizing dye, there are such defects that high sensitivity is not well obtained, and there is a large change in photographic performance due to the passage of time or a change n the interval from exposure to light to processing, which defects have constituted a great impediment to the improvement of silver halide photographic materials excellent in rapid processability.

Some techniques have been proposed to overcome the above defects of silver halide emulsions high in silver halide content.

The correlation of the spectrally sensitized sensitivity of high silver chloride emulsions and the reduction potential of the spectrally sensitizing dyes is reported in *Photographic Science and Engineering,* Vol. 18, pages 475 to 485 (1974), and in *The Journal of Photographic Science,* Vol. 21, pages 180 to 186 (1973). In order to improve, for example, the prevention of infrared fogging, maintaining quality over time, or the spectral sensitivity of silver halide emulsions containing silver chloride sensitized spectrally with specific red-sensitive sensitizing dyes, JP-B ("JP-B" means examined Japanese patent publication) Nos. 10473/1971 and 42494/1973 suggest adding nitrogen-containing compounds, JP-A ("JP-A" means unexamined published Japanese patent application) No. 5035/1975 suggests adding supersensitizers, JP-A No. 151026/1977 suggests adding water-soluble bromides, JP-A No. 23520/1979 suggests adding iridium, JP-A No. 202436/1985 suggests adding hardening agents, JP-A No. 7629/1983 suggests improving the way of adding spectrally sensitizing dyes, and JP-A No. 225147/1985 suggests using silver chlorobromide that has (100) and (111) planes.

However, even these techniques have not been able to overcome sufficiently the impediment of the above case wherein silver halide emulsions high in silver halide content are spectrally sensitized with red-sensitive sensitizing dyes.

European Patent Application Publication EP3130-21A discloses a technique for reducing the change of photographic sensitivity due to a change of temperature during exposure to light in the case wherein emulsions high in silver chloride content are spectrally sensitized with red-sensitive sensitizing dyes. However, in accordance with the inventors' study, it is found that, with this technique, the change of photographic sensitivity due to a change of the interval from exposure to light to processing, that is, the latent-image-keeping property, is not satisfactory, which constitute a great impediment in practice.

BRIEF SUMMARY OF THE INVENTION

Therefore, the object of the present invention is to provide a silver halide photographic material that is excellent in rapid processability and high in sensitivity, and wherein there is little change of photographic performance due to the passage of time or a change of the interval from exposure to light to processing.

Other and further objects, features, and advantages of the invention will appear more fully from the following description.

DETAILED DESCRIPTION OF THE INVENTION

The object of the present invention has been achieved by providing a silver halide photographic material having on its base at least one photosensitive emulsion layer containing a nitrogen-containing heterocyclic compound and a silver halide emulsion having a silver chloride content of 90 mol % or more, which emulsion has been spectrally sensitized with a red-sensitive sensitizing dye having a reduction potential value of −1.27 V (vs SCE) or a value baser than that, and which has been subjected to reduction sensitization.

The present invention will now be further described in detail.

In the present invention, the reduction potential of red-sensitive sensitizing dyes is −1.27 V (vs SCE) or a value baser than that, preferably −1.285 V to −1.60 V (vs SCE), more preferably −1.29 V to −1.40 V (vs SCE). The measurement of the reduction potential was effected by phase discrimination-type second higher harmonics AC polarography. The details are described below. As the solvent for the red-sensitive sensitizing dyes, acetonitrile (spectral grade) dried in 4A-1/16 molecular sieves, and as the supporting electrolyte, normal tetrapropyl ammonium perchlorate (an agent made specially for polarographs) were used. Each of the sample solutions was prepared by dissolving the red-sensitive sensitizing dye in acetonitrile containing 0.1 mol of the support electrolyte, so that the amount of the red-sensitive sensitizing dye might be $10^{-3}$ to $10^{-5}$ mol/l, and before the measurement it was then deoxidized for 15 min with extremely pure argon gas (99.999 %) that had been first passed through a highly alkaline aqueous solution of pyrogallol, followed by calcium chloride. As the work electrode, a mercury dropping electrode, as the reference electrode, a saturated calomel electrode (SCE), and as the counter electrode, platinum were used. The reference electrode and the sample solution were connected through a Luggin tube filled with acetonitrile containing 0.1 mol of the support electrolyte, and Vicor glass was used for the liquid-junction. The measurement was carried out at 25° C. with the tip of the Luggin tube and the tip of the mercury capillary spaced 5 to 8 mm apart. The measurement of reduction potential by phase discrimination-type second higher harmonics AC voltammetry using platinum as a reference electrode is described in *Journal of Imaging Science*, Vol. 30, pages 27 to 35 (1986).

Preferably, the red-sensitive sensitizing dye used in the present invention is represented by the following formula (I):

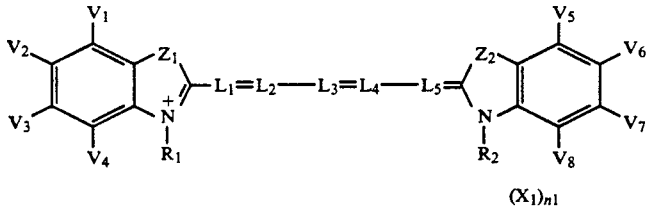

Formula (I)

wherein $Z_1$ represents a nitrogen atom, an oxygen atom, a sulfur atom, or a selenium atom, and $Z_2$ represents an oxygen atom, a sulfur atom, or a selenium atom, $L_1$, $L_2$, $L_3$, $L_4$, and $L_5$ each represent a methine group, which may be substituted, for example, by a substituted or unsubstituted alkyl group (e.g., methyl and ethyl), a substituted or unsubstituted aryl group (e.g., phenyl), or a halogen atom (e.g., chlorine and bromine), and may form a ring together with another methine group, $R_1$ and $R_2$, which may be the same or different, each represent an alkyl group, preferably an unsubstituted alkyl group having up to 18 carbon atoms (e.g., methyl, ethyl, propyl, butyl, pentyl, octyl, decyl, dodecyl, and octadecyl) or a substituted alkyl group {e.g., an alkyl group having up to 18 carbon atoms as described before and substituted, for example, by a carboxyl group, a sulfo group, a cyano group, a halogen-atom (e.g., fluorine, chlorine, and bromine), a hydroxyl group, an alkoxycarbonyl group having up to 8 carbon atoms (e.g., methoxycarbonyl, ethoxycarbonyl, phenoxycarbonyl, and benzyloxycarbonyl), an alkoxy group having up to 8 carbon atoms (e.g., methoxy, ethoxy, benzyloxy, and phenethyloxy), a monocyclic aryloxy group having up to 10 carbon atoms (e.g., phenoxy and p-tolyloxy), an acyloxy having up to 3 carbon atoms (e.g., acetyloxy and propionyloxy), an acyl group having up to 8 carbon atoms (e.g., acetyl, propionyl, benzoyl, and mesyl), a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), or an aryl having up to 10 carbon atoms (e.g., phenyl, 4-chlorophenyl, 4-methylphenyl, and α-naphthyl)}, and particularly preferably an unsubstituted alkyl group (e.g., methyl and ethyl), or a sulfoalkyl group (e.g., 2-sulfoethyl, 3-sulfopropyl, and 4-sulfobutyl), $R_1$ and $L_1$ may bond together to form a 5- or 6-membered carbon ring and/or $R_2$ and $L_5$ may bond together to form a 5- or 6-membered carbon ring, $V_1$, $V_2$, $V_3$, $V_4$, $V_5$, $V_6$, $V_7$, and $V_8$ each represent a hydrogen atom, a halogen atom (e.g., chlorine, fluorine, and bromine), an unsubstituted alkyl group, preferably an unsubstituted alkyl group having up to 10 carbon atoms (e.g., methyl and ethyl), a substituted alkyl group, preferably a substituted alkyl group having up to 18 carbon atoms (e.g., benzoyl, α-naphthylmethyl, 2-phenylethyl, and trifluoromethyl), an acyl group, preferably an acyl group having up to 10 carbon atoms (e.g., acetyl, benzoyl, and mesyl), an acyloxy group, preferably an acyloxy group having up to 10 carbon atoms (e.g., acetyloxy), an alkoxycarbonyl group, preferably an alkoxycarbonyl group having up to 10 carbon atoms (e.g., methoxycarbonyl, ethoxycarbonyl, and benzyloxycarbonyl), a substituted or unsubstituted carbamoyl (e.g., carbamoyl, N,N-dimethylcarbamoyl, morpholinocarbonyl, and piperidinocarbonyl), a substituted or unsubstituted sulfamoyl group (e.g., sulfamoyl, N,N-dimethylsulfamoyl, morpholinosulfonyl, and piperidinosulfonyl), a carboxyl group, a cyano group, a hydroxyl group, an amino group, an acylamino group, preferably an acylamino group having up to 8 carbon atoms (e.g., acetylamino), an alkoxy group, preferably an alkoxy group having up to 10 carbon atoms (e.g., methoxy, ethoxy, and benzyloxy), an alkylthio group (e.g., ethylthio), an alkylsulfonyl group (e.g., methylsulfonyl), a sulfonic acid group, an aryloxy group (e.g., phenoxy), or an aryl group (e.g., phenyl and tolyl), and out of $V_1$ to $V_8$, two bonded to the adjacent carbon atoms may bond together to form a condensed ring such as a benzene ring or a heterocyclic ring (e.g., pyrrole, thiophene, furan, pyridine, imidazole, triazole, and thiazole), and $(X_1)_{n1}$ is contained in the formula to indicate the presence or absence of a cation or an anion when required to neutralize the ion charge of the dye, and therefore n1 can take a suitable value of 0 or over if required.

Whether a certain dye is a cation or an anion, or has a net ion charge depends on its auxochrome and substituent. The counter ion $(X_1)_{n1}$ can be readily exchanged after the dye is produced. Typical cations are inorganic or organic ammonium ions and alkali metal ions. On the other hand, specifically the anion may be an inorganic anion or an organic anion, such as a halide anion (e.g., a fluorine ion, a chloride ion, a bromide ion, and an iodine ion), a substituted arylsulfonic acid ion (e.g., a p-toluenesulfonic acid ion and a p-chlorobenzenesulfonic acid ion), an aryldisulfonic acid ion (e.g., a 1,3-benzenesulfonic acid ion, a 1,5-naphthalenedisulfonic acid ion, and a 2,6-naphthalenedisulfonic acid ion), an alkylsulfonic acid ion (e.g., a methylsulfonic acid ion), a sulfonic acid ion, a thiocyanic acid ion, a perchloric acid ion, a tetrafluoroboric acid ion, a picric acid ion, an acetic acid ion, and a trifluoromethanesulfonic acid ion, with preference given to an iodide ion.

Of red-sensitive sensitizing dyes represented by formula (I), preferable red-sensitive sensitizing dyes are those represented by the following formulae (II) and (III):

$R_3$ and $R_4$ each have the same meaning as that of $R_1$ and $R_2$ of formula (I), $R_3$ and $L_6$ may bond together to form a 5- or 6-membered carbon ring, and $R_4$ and $L_7$ may bond together to form a 5- or 6-membered carbon ring, $V_9$, $V_{10}$, $V_{11}$, $V_{12}$, $V_{13}$, $V_{14}$, $V_{15}$, and $V_{16}$ each represent a hydrogen atom or a substituent defined for $V_1$, $V_2$, $V_3$, $V_4$, $V_5$, $V_6$, $V_7$, and $V_8$ in formula (I); out of $V_9$ to $V_{16}$, two bonded to adjacent carbon atoms cannot form a condensed ring, by defining their Hammett $\sigma_p$ values as $\sigma_{pi}$ (i=9 to 16), if $Y_0=\sigma_{p9}+\sigma_{p10}+\sigma_{p11}+\sigma_{p12}+\sigma_{p13}+\sigma_{p14}+\sigma_{p15}+\sigma_{p16}$, then when $Z_3$ is an oxygen atom, $Y_0 \leqq -0.08$, while when $Z_3$ is a sulfur atom, $Y_0 \leqq -0.15$, preferably the value $Y_0$ is such that when $Z_3$ is an oxygen atom, $Y_0 \leqq -0.15$, while when $Z_3$ is a sulfur atom, $Y_0 \leqq -0.30$, and more preferably the value $Y_0$ is such that when $Z_3$ is an oxygen atom, $-0.90 \leqq Y_0 \leqq -0.17$, while when $Z_3$ is a sulfur atom, $-1.05 \leqq Y_0 \leqq -0.34$.

Herein, $\sigma_p$ represents the value described in *Yakubutsu no Kozo Kassei Sokan/Draggu Dezain to Sayokiko Kenkyu eno Shishin,* pages 96 to 103, in *Kagaku no Ryoiki,* extra number 122 (1979), edited by Kozo Kassei Sokan Konwa-kai, published by Nanko-do, and also described by Corwin Hansch and Albert Leo in *Substituent Constants for Correlation Analysis in Chemistry and Biology,* pages 69 to 161, published by John Wiley and Sons. The method for measuring $\sigma_p$ is described in *Chemical Reviews,* Vol. 17, pages 125 to 136 (1935). Preferably, $V_9$, $V_{10}$, $V_{11}$, $V_{12}$, $V_{13}$, $V_{14}$, $V_{15}$, and $V_{16}$ each represent a hydrogen atom, an unsubstituted alkyl group having up to 6 carbon atoms (e.g., methyl, ethyl, n-propyl, isopropyl, n-butyl, t-butyl, pentyl, cyclopropyl, cyclobutyl, cyclopentyl, and cyclohexyl), a substituted alkyl group having up to 8 carbon atoms (e.g., carboxymethyl, 2-carboxyethyl, benzyl, phenethyl, and dimethylaminopropyl), a hydroxyl group, an amino group (e.g., amino, hydroxyamino, methylamino, dimethylamino, and diphenylamino), an alkoxy group (e.g., methoxy, ethoxy, isopropoxy, propoxy, butoxy, and pentoxy), an aryloxy group (e.g., phenoxy), or an aryl group (e.g., phenoxy).

$(X_2)_{n2}$ has the same meanings as $(X_1)_{n1}$ of formula (I).

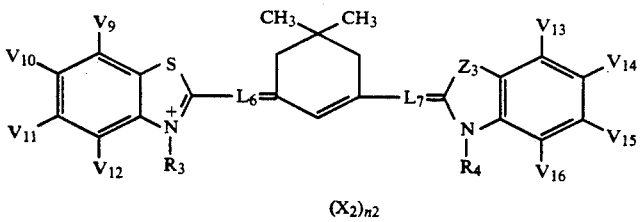

Formula (II)

$(X_2)_{n2}$

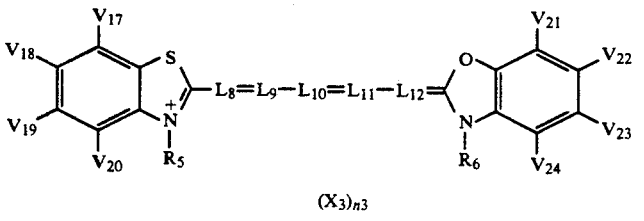

Formula (III)

$(X_3)_{n3}$

Formula (II) will be described below.

In formula (II), $Z_3$ represents an oxygen atom or a sulfur atom, $L_6$ and $L_7$ each represent a methine group, Formula (III) will be described below.

$L_8$, $L_9$, $L_{10}$, $L_{11}$, and $L_{12}$ have the same meanings as those of $L_1$, $L_2$, $L_3$, $L_4$, and $L_5$ of formula (I), and preferably each represents a methine group substituted by a substituent wherein the Hammett $\sigma_p$ value is negative, such as a substituted or unsubstituted alkyl group (e.g., methyl and ethyl). More preferably, $L_9$ and $L_{11}$ bond together to form a 5- to 6-membered carbon ring.

$R_5$ and $R_6$ have the same meaning as those of $R_1$ and $R_2$ of formula (I).

Out of $V_{17}$, $V_{18}$, $V_{19}$, $V_{20}$, $V_{21}$, $V_{21}$, $V_{22}$, $V_{23}$, and $V_{24}$, at least one set of twos bonded to adjacent carbon atoms is bonded together to form a benzene ring or a heterocyclic ring (e.g., pyrrole, thiophene, furan, pyridine, imidazole, triazole, and thiazole), which may be further substituted. Other of $V_{17}$ to $V_{28}$ not related to them have the same meanings as those of $V_1$ to $V_8$ in formula (I).

$(X_3)_{n3}$ has the same meaning as $(X_1)_{n1}$ of formula (I).

Specific examples of the dyes represented by formulae (I), (II), and (III) of the present invention are shown below, but the present invention is not limited to them.

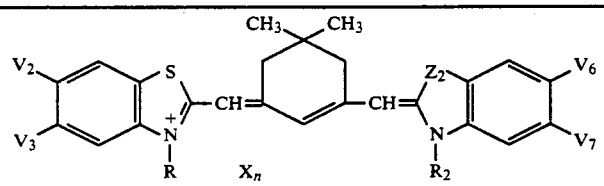

| | | $R_1$ | $R_2$ | $V_2$ | $V_3$ | $V_6$ | $V_7$ | X | n | $E_R$ |
|---|---|---|---|---|---|---|---|---|---|---|
| | $Z_2$ | | | | | | | | | |
| I-1 | S | $CH_3CH_2$ | $CH_3CH_2$ | $CH_3$ | H | H | H | $I^-$ | 1 | −1.27 |
| I-2 | " | " | " | $CH_3$ | $CH_3$ | H | H | " | " | −1.29 |
| I-3 | " | " | " | $CH_3$ | H | $CH_3$ | H | " | " | −1.29 |
| I-4 | " | " | " | $CH_3$ | H | H | $CH_3$ | " | " | −1.28 |
| I-5 | " | " | " | H | $CH_3$ | H | $CH_3$ | " | " | −1.27 |
| | $Z_3$ | | | | | | | | | |
| I-6 | " | " | " | $CH_3O$ | H | H | H | " | " | −1.27 |
| I-7 | S | $CH_3CH_2$ | $CH_3CH_2$ | $CH_3O$ | $CH_3O$ | H | H | $I^-$ | 1 | −1.29 |
| I-8 | " | " | " | $CH_3O$ | H | $CH_3O$ | H | " | " | −1.30 |
| I-9 | " | " | " | $CH_3O$ | H | H | $CH_3O$ | " | " | −1.29 |
| I-10 | " | " | " | H | $CH_3O$ | H | $CH_3O$ | " | " | −1.28 |
| I-11 | " | " | " | $CH_3$ | $CH_3$ | $CH_3$ | $CH_3$ | " | " | −1.33 |
| I-12 | " | " | " | $CH_3O$ | $CH_3O$ | $CH_3O$ | $CH_3O$ | " | " | −1.34 |
| I-13 | " | " | " | $CH_3O$ | $CH_3$ | H | H | " | " | −1.29 |
| I-14 | " | " | " | $CH_3CH_2O$ | H | $CH_3CH_2O$ | H | " | " | −1.30 |
| I-15 | " | " | " | $CH_3CH_2$ | H | $CH_3CH_2$ | H | " | " | −1.28 |
| | $Z_2$ | | | | | | | | | |
| I-16 | S | $CH_3CH_2$ | $CH_3CH_2$ | $CH_3(CH_2)_2$ | H | $CH_3(CH_2)_2$ | H | $I^-$ | 1 | −1.28 |
| I-17 | " | " | " | $N(CH_3)_2$ | H | H | H | " | " | −1.28 |
| I-18 | " | $(CH_2)_3SO_3^-$ | " | $CH_3$ | H | $CH_3$ | H | — | — | −1.29 |
| I-19 | " | $(CH_2)_4SO_3^-$ | " | $CH_3$ | H | $CH_3$ | H | — | — | −1.29 |
| I-20 | " | $(CH_2)_3SO_3^-$ | $(CH_2)_3SO_3^-$ | $CH_3$ | H | $CH_3$ | H | $\overset{+}{H}NEt_2$ | 1 | −1.29 |
| I-21 | " | $(CH_2)_4SO_3^-$ | $(CH_2)_4SO_3^-$ | $CH_3$ | H | $CH_3$ | H | 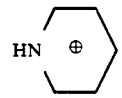 | 1 | −1.29 |
| I-22 | " | $CH_3(CH_2)_4$ | $CH_3CH_2$ | $CH_3$ | H | $CH_3$ | H | $I^-$ | 1 | −1.29 |
| I-23 | " | $CH_3(CH_2)_4$ | $(CH_2)_3SO_4^-$ | $CH_3$ | H | $CH_3$ | H | — | — | −1.29 |
| I-24 | " | $CH_3$ | $CH_3$ | $CH_3$ | H | $CH_3$ | H | $I^-$ | 1 | −1.29 |
| I-25 | S | $(CH_2)_3SO_4^-$ | $(CH_2)_4SO_4^-$ | $CH_3$ | H | $CH_3$ | H | $\overset{+}{H}NEt_2$ | 1 | −1.29 |
| I-26 | " | $CH_3$ | $CH_3(CH_2)_2$ | $CH_3$ | H | $CH_3$ | H | $I^-$ | 1 | −1.29 |
| I-27 | " | $(CH_2)_3SO_3^-$ | $CH_3CH_2$ | $CH_3O$ | $CH_3O$ | H | H | — | — | −1.29 |
| I-28 | " | $CH_3CH_2$ | $(CH_2)_3SO_3^-$ | $CH_3O$ | $CH_3O$ | H | H | — | — | −1.29 |
| I-29 | O | $CH_3CH_2$ | $CH_3CH_2$ | $CH_3$ | H | H | H | $I^-$ | 1 | −1.29 |
| I-30 | " | " | " | H | $CH_3$ | H | H | " | " | −1.28 |
| I-31 | " | " | " | $CH_3$ | $CH_3$ | H | H | " | " | −1.31 |
| I-32 | " | " | " | $CH_3$ | H | $CH_3$ | H | " | " | −1.31 |
| I-33 | " | " | " | $CH_3$ | H | H | $CH_3$ | " | " | −1.30 |
| I-34 | " | " | " | H | $CH_3$ | H | $CH_3$ | " | " | −1.29 |

(I-35)

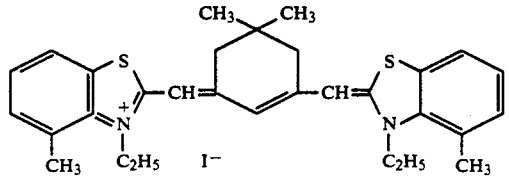

$E_R = -1.29$

-continued
(I-36)
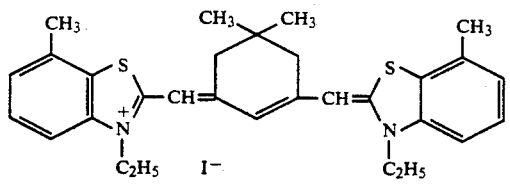
$E_R = -1.28$
(I-37)
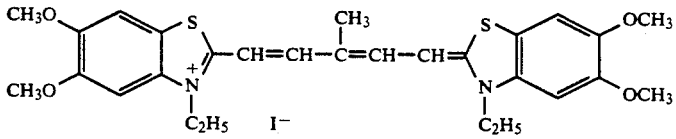
$E_R = -1.27$
(I-38)
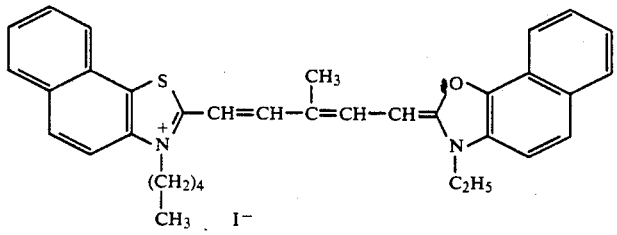
$E_R = -1.27$
(I-39)
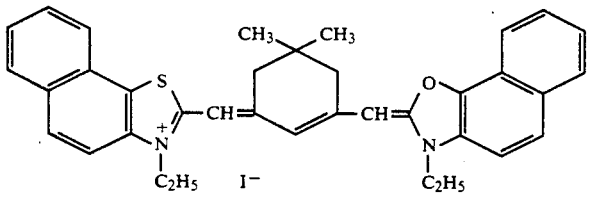
$E_R = -1.33$
(I-40)
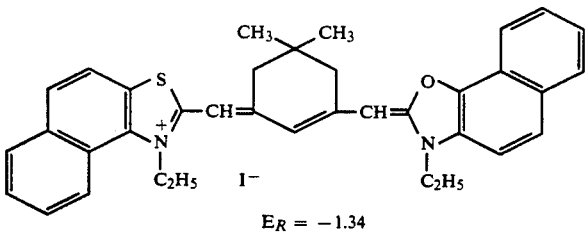
$E_R = -1.34$
(I-41)
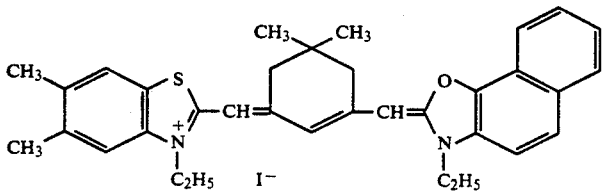
$E_R = -1.34$ -continued (I-42)

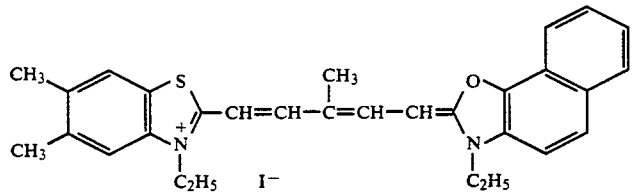

$E_R = -1.28$

The dyes represented by formula (I) used in the present invention can be synthesized easily based on processes described, for example, by F. M. Hamer in *Heterocyclic Compounds—Cyanine Dyes and Related Compounds,* Chapter IX, pages 270 to 287, published by John Wiley and Sons (1964), and by D. M. Sturmer in *Heterocyclic Compounds—Special Topics in Heterocyclic Chemistry,* Chapter VIII, Sec. IV, pages 482 to 515, published by John Wiley and Sons (1977).

To incorporate the spectrally sensitizing dye represented by formula (I), (II), or (III) into the silver halide emulsion of the present invention, the dye may be dispersed directly into the emulsion, or it may be first dissolved in a solvent, such as water, methanol, ethanol, propanol, methyl Cellosolve, and 2,2,3,3-tetrafluoropropanol, or a mixture thereof, with the solution added to the emulsion. Alternatively the dye may be formed into an aqueous solution in the presence of an acid or a base, as described in JP-B Nos. 23389/1969, 27555/1969, and 22089/1982, or it may be formed into an aqueous solution or a colloid dispersion in the presence of a surface-active agent, as described in U.S. Pat. Nos. 3,822,135, and 4,006,025, which is then added to the emulsion. The dye may also be dissolved in a solvent substantially incompatible with water, such as phenoxyethanol, and then the solution is dispersed in water or a hydrophilic colloid, the dispersion is added to the emulsion. Also the dye may be directly dispersed in a hydrophilic colloid as described in JP-A Nos. 102733/1978 and 105141/1983, and the dispersion may be added to the emulsion. The time when the dye is added to the emulsion may be at any stage of preparing the emulsion that is hitherto known as useful. Most commonly, although the dye is added in a stage after the completion of chemical sensitization and before the coating, the addition of the dye may be carried out simultaneously with the addition of a chemical sensitizer, as described in U.S. Pat. Nos. 3,628,969 and 4,225,666, to effect the spectral sensitization simultaneously with the chemical sensitization, or the addition of the dye may be carried out prior to the chemical sensitization, as described in JP-A No. 113928/1983, or, the dye may be added to start spectral sensitization before completion of the production of the silver halide grain precipitate. Further, the compound may be added in portions, as taught in U.S. Pat. No. 4,225,666, that is, a portion of the compound is added before the chemical sensitization, and the remaining portion is added after the chemical sensitization, or the dye may be added in any stage during the formation of silver halide grains, for example in the way described in U.S. Pat. No. 4,183,756.

The amount of the compound represented by formula (I), (II), or (III) to be added may generally be about $4\times10^{-6}$ to $8\times10^{-3}$ mol, preferably $1\times10^{-6}$ to $1\times10^{-3}$ mol, and more preferably $5\times10^{-5}$ to $5\times10^{-4}$ mol, per mol of the silver halide of the silver halide emulsion of the layer containing the particular high silver chloride emulsion.

The nitrogen-containing heterocyclic compounds used in the present invention are preferably compounds containing a saturated or unsaturated 5- to 7-membered ring having at least one nitrogen atom as a hetero atom, which ring may be further substituted, it may have a condensed ring, and it may have another hetero atom than the nitrogen atom. Preferable examples are compounds represented by the following formula (IV):

$$Z—Y \qquad (IV)$$

wherein

Z represents specifically an azole ring (e.g., imidazole, triazole, tetrazole, thiazole, oxazole, selenazolebenzimidazole, benzindazole, benztriazole, benzoxazole, benzthiazole, thiadiazole, oxadiazole, benzselenazole, pyrazole, naphthothiazole, naphthoimidazole, naphthooxazole, azabenzimidazole, and purine), a pyrimidine ring, a triazine ring, a pyridine ring, or an azaindene ring (e.g., triazaindene, tetrazaindene, and petazaindene), and Y represents a hydrogen atom or a substituent, and specifically a substituted or unsubstituted alkyl group (e.g., methyl, ethyl, hydroxyethyl, trifluoromethyl, sulfopropyl, dipropylaminoethyl, and adamantane), an alkenyl group (e.g., allyl), an aralkyl group (e.g., benzyl and p-chlorophenethyl), an aryl group (e.g., phenyl, naphthyl, p-carboxyphenyl, 3,5-dicarboxypheny, m-sulfophenyl, p-acetamidophenyl, 3-caprylamidophenyl, p-sulfamoylphenyl, m-hydroxyphenyl, p-nitrophenyl, 3,5-dichlorophenyl, and 2-methoxyphenyl), a heterocyclic residue (e.g., pyridine), a halogen atom (e.g., chlorine and bromine), a mercapto group, a cyano group, a carboxyl group, a sulfo group, a hydroxyl group, a carbamoyl group, a sulfamoyl group, an amino group, a nitro group, an alkoxy group (e.g., methoxy and ethoxy), an aryloxy group (e.g., phenoxy), an acyl group (e.g., acetyl), an acylamino group (e.g., acetylamino, capramido, and methylsulfonylamino), a substituted amino (e.g., diethylamino and hydroxyamino), an alkylthio or arylthio group (e.g., methylthio, carboxyethylthio, and sulfobutylthio), or an aryloxycarbonyl group (e.g., phenoxycarbonyl).

Other preferable examples of the nitrogen-containing heterocyclic compound may be disulfides represented by the following formula (V):

$$Z—S—S—Z \qquad (V)$$

or compounds having a thioketone group represented by the following formula (VI):

Formula (VI)

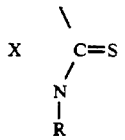

wherein

R represents an alkyl group, an aralkyl group, an alkenyl group, or an aryl group, and X represents a group of atoms required to form a 5- to 6-membered ring, which may be condensed.

The heterocyclic ring formed by X includes, for example, thiazoline, thiazolidine, selenazoline, oxazoline, oxazolidine, imidazoline, imidazolidine, thiadiazoline, oxadiazoline, triazoline, tetrazoline, and pyrimidine, and also benzthiazoline, naphthothiazoline, tetrahydrobenzthiazoline, benzimidazoline, and benzoxazoline wherein a carbon ring or heterocyclic ring is condensed.

These heterocyclic rings may be substituted by a substituent Y, mentioned for the compounds represented by formula (IV).

Specifically R includes an alkyl group (e.g., methyl, propyl, sulfopropyl, and hydroxyethyl), an alkenyl group (e.g., aryl), an aralkyl group (e.g., benzyl), an aryl group (e.g., phenyl, p-tolyl, and o-chlorophenyl), and a heterocyclic group (e.g., pyridyl).

In the present invention, the heterocyclic compounds containing nitrogen are preferably azoles, and particularly preferably azoles having a mercapto group.

Examples of typical compounds represented by formula (IV) are shown below:

(IV-1)

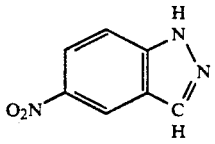

(IV-2)

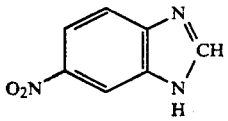

(IV-3)

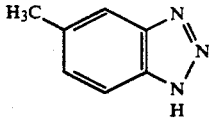

(IV-4)

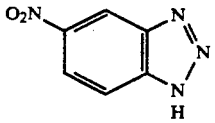

(IV-5)

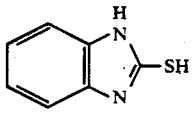

-continued (IV-6)

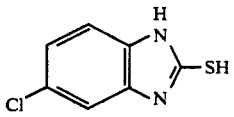

(IV-7)

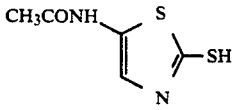

(IV-8)

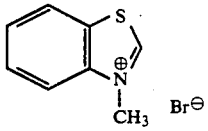

(IV-9)

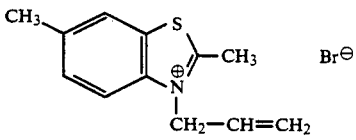

(IV-10)

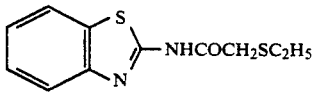

(IV-11)

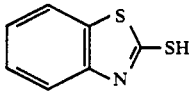

(IV-12)

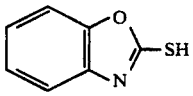

(IV-13)

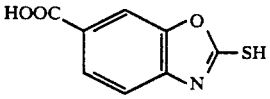

(IV-14)

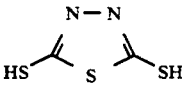

(IV-15)

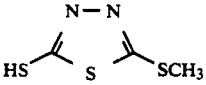

(IV-16)

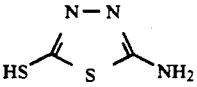

(IV-17)

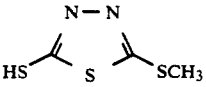

-continued
(IV-18)
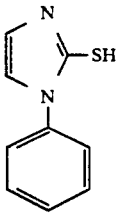
(IV-19)
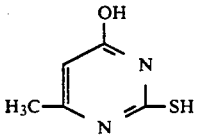
(IV-20)
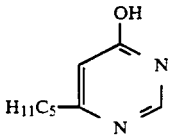
(IV-21)
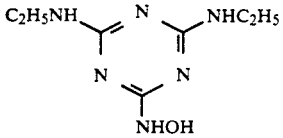
(IV-22)
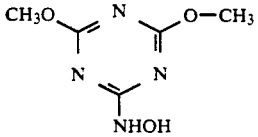
(IV-23)
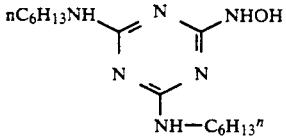
(IV-24)
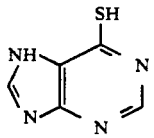
(IV-25)
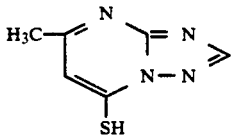
(IV-26)
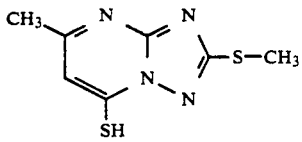
-continued
(IV-27)
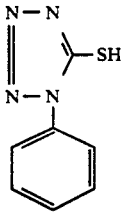
(IV-28)
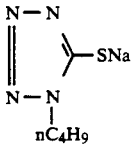
(IV-29)
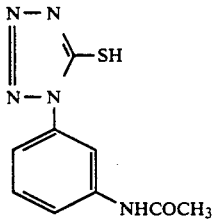
(IV-30)
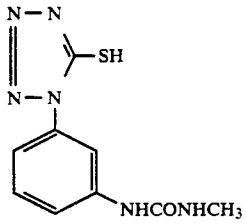
(IV-31)
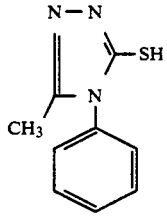
(IV-32)
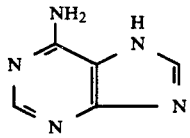
(IV-33)
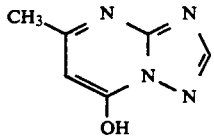
(IV-34)
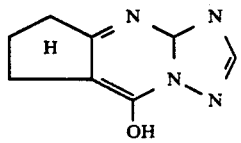

-continued

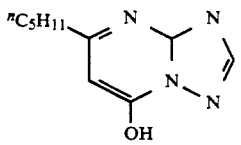

(IV-35)

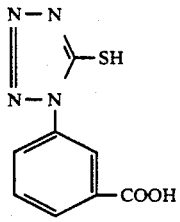

(IV-36)

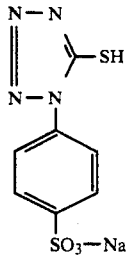

(IV-37)

Example of typical compound represented by formula (V) is shown below:

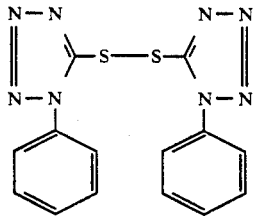

(V-1)

Examples of typical compounds represented by formula (VI) are shown below:

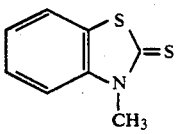

(VI-1)

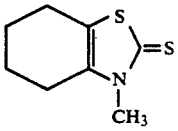

(VI-2)

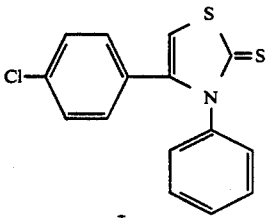

(VI-3)

-continued

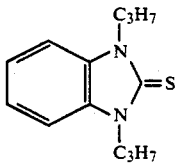

(VI-4)

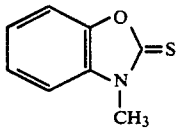

(VI-5)

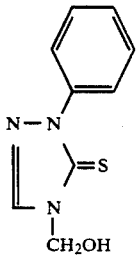

(VI-6)

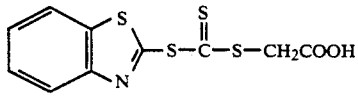

(VI-7)

These compounds can be obtained by consulting, for example, the literature cited by E. J. Birr in *Stabilization of Photographic Silver Halide, Emulsions,* published by Focal Press (1974), in *Reports on the Progress of Applied Chemistry,* Vol. 59, page 159 (1974), in *Research Disclosure,* No. 17643 (1978), in JP-B Nos. 34169/1973, 18008/1972, and 23368/1974, in *Yakugaku Zasshi,* Vol. 74, pages 1365 to 1369, and in *Beilstein,* Chapter XII, page 394, and Chapter IV, page 121.

To add the nitrogen-containing heterocyclic compound to a dispersing medium such as gelatin, the above-mentioned method for adding a spectrally sensitizing dye can be applied.

Although the amount of the nitrogen-containing heterocyclic compound in the dispersing medium will vary depending on the conditions, the amount is $1\times10^{-5}$ to $4\times10^{-2}$ mol/mol of silver, preferably $5\times10^{-5}$ to $2\times10^{-2}$ mol/mol of silver, and more preferably $1\times10^{-4}$ to $1\times10^{-2}$ mol/mol of silver.

The stage where the nitrogen-containing compound is added may be at any time before or after completion of the preparation of the emulsion. The nitrogen-containing compound can be added in two or more portions in separate stages.

The halogen composition of the silver halide grains used in the present invention is such that 90 mol % of the total silver halide constituting silver halide grains is required to be silver chloride, and preferably the halogen composition is substantially free from silver iodide. The expression "substantially free from silver iodide" means that the silver iodide content is 1.0 mol % or less. Preferable halogen compositions of the silver halide grains are composed of silver chlorobromide substantially free from silver iodide, wherein 95 mol % or more of the total silver halide constituting the silver halide grains is composed of silver chloride.

It is most preferable that the silver halide grains used in the present invention are composed of silver bromide, or pure silver chloride containing practically no silver iodide, or silver chlorobromide substantially free from silver iodide wherein 2 mol % or less of the total silver halide constituting the silver halide grains is composed of silver bromide.

In the case of silver chlorobromide grains wherein 2% or less is composed of silver bromide, the grains can have a localized phase wherein the silver bromide content is over 20%.

The arrangement of such a localized phase wherein the silver bromide content is different can be taken arbitrarily according to the purpose, and the localized phase wherein the silver bromide content is high may be present inside the silver halide grains, or on the surface or the subsurface of the silver halide grains, or it may be shared between the inside and the surface or the subsurface. On the inside or on the surface, the localized phase may have a layered structure to surround the silver halide grain, or it may have a discontiuously isolated structure. A preferable specific example of the arrangement of the localized phase wherein the silver bromide content is high is one wherein a localized phase having a silver bromide content of more than 20 mol % is locally grown epitaxially on the silver halide grain surface.

As the silver halide grains of the present invention, ones having (100) plane or (111) plane, or both (100) and (111), or a more higher plane can be preferably used, with ones having mainly the (100) plane most preferable. The shape of the silver halide grains of the present invention may be of irregular crystalline forms, such as spheres. Emulsions made up of tabular grains may be used, and also use may be made of emulsions wherein tabular grains having a length/thickness ratio of 5 or over, and particularly 8 or over, amount to 50% or more of the total projected area of the grains.

It is proper if the size of the silver halide grains of the present invention falls within the range that is usually used, and preferably the average grain diameter is 0.1 μm to 1.5 μm. The grain diameter distribution may be polydisperse or monodisperse, with monodisperse preferable. Preferably the grain size distribution representing the degree of monodisperse distribution is 0.2 or below, and more preferably 0.15 or below, in terms of the ratio ($s/\bar{d}$) of the statistical standard deviation (s) to the average grain size ($\bar{d}$). It is also possible to use a mixture of two or more monodisperse emulsions.

A supersensitizing dye can be used together with the present red-sensitive sensitizing dye.

Supersensitizing dyes are described, for example, in *Photographic Science and Engineering*, Vol. 13, pages 13 to 17 (1969), and Vol. 18, pages 418 to 430 (1974), and by James in *The Theory of the Photographic Process*, 4th edition, page 259, Macmillan (1977), and by properly selecting a combination of a sensitizing dye and a supersensitizing dye, higher sensitivity can be obtained.

Although it is possible to use any supersensitizing dye, particularly preferable supersensitizing dyes are compounds represented by the formula (VII):

Formula (VII)

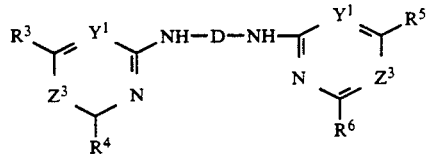

wherein

D represents a divalent aromatic residue, $R_3$, $R_4$, $R_5$, and $R_6$ each represent a hydrogen atom, a hydroxyl group, an alkoxy group, an aryloxy group, a halogen atom, a heterocyclyl group, a mercapto group, an alkylthio group, an arylthio group, a heterocyclyl thio group, an amino group, an alkylamino group, a cyclohexylamino group, an arylamino group, a heterocyclyl amino group, an aralkylamino group, or an aryl group, and $Y^1$ and $Z^3$ each represent —N= or —CH=, provided that at least one of $Y^1$ and $Z^3$ is —N=.

Formula (VII) will now be further described in detail.

D represents a divalent aromatic residue (e.g., a single aromatic nucleus residue, a residue of at least two aromatic nuclei that are condensed, or a residue of at least two aromatic nuclei that are bonded directly or through an atom or a group, or more specifically one having a biphenyl, naphthylene, stilbene, or bibenzyl skeleton), and more preferably one represented by the following $D_1$ or $D_2$:

$D_1$:

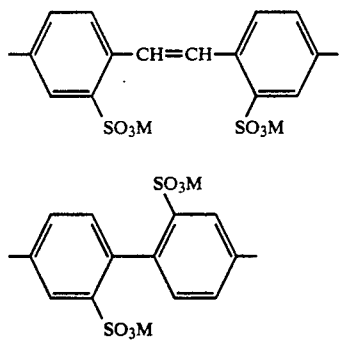

wherein M represents a hydrogen atom or a cation that renders the compound soluble in water (e.g., an alkali metal ion, such as Na and K, or an ammonium ion).

$D_2$:

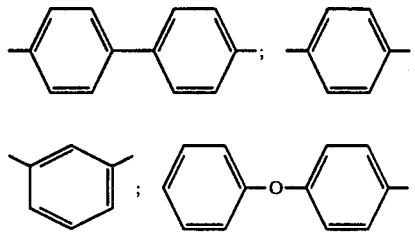

-continued

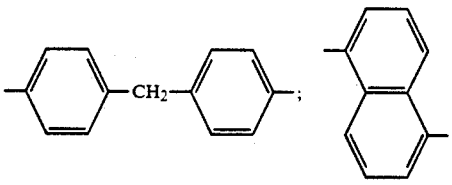

In the case of $D_2$, at least one of $R^3$, $R^4$, $R^5$, and $R^6$ has a substituent containing $SO_3M$. M has the same meaning as above.

$R^3$, $R^4$, $R^5$, and $R^6$ each represent a hydrogen atom, a hydroxyl group, an alkoxy group (e.g., methoxy and ethoxy), an aryloxy group (e.g., phenoxy, naphthoxy, o-tolyloxy, and p-sulfophenoxy), a halogen atom (e.g., chlorine and bromine), a heterocyclyl group (e.g., morpholinyl and piperidyl), a mercapto group, an alkylthio group (e.g., methylthio and ethylthio), an arylthio group (e.g., phenylthio and tolylthio), a heterocyclyl thio group (e.g., benzothiazoylthio, benzoimidazoylthio, and phenyltetrazoylthio), an amino group, an alkylamino group (e.g., methylamino, ethylamino, propylamino, dimethylamino, diethylamino, dodecylamino, β-hydroxylethylamino, di-β-hydroxyethylamino, and β-sulfoethylamino), a cyclohexylamino group, an arylamino group (e.g., anilino, o-, m-, or p-sulfoanilino, o-, m-, or p-chloroanilino, o-, m-, or p-anisidino, o-, m-, or p-toluidino, o-, m-, or p-carboxyanilino, hydroxyanilino, sulfonaphthylamino, o-, m-, or p-aminoanilino, and o-acetamino-anilino), a heterocyclyl amino group (e.g., 2-benzothiazolylamino and 2-pyridylamino), an aralkylamino group (e.g., benzylamino), or an aryl group (e.g., phenyl).

Out of the compounds represented by formula (VII), those wherein at least one of $R^3$ to $R^6$ is an aryloxy group, a heterocyclyl thio group, or a heterocyclic amino group are particularly preferable.

Typical examples of the compounds represented by formula (VII) are given below, but the present invention is not limited to them.

(VII-1): disodium 4,4'-bis[2,6-di(benzothiazolyl-2-thio)-pyrimidin-4-ylamino]stilbene-2,2'-disulfonate (VII-2): disodium 4,4'-bis[2,6-di(benzothiazolyl-2-amino)pyrimidin-4-ylamino]stilbene-2,2'-disulfonate (VII-3): disodium 4,4'-bis[2,6-di(1-phenyltetrazolyl-5-thio)pyrimidin-4-ylamino]stilbene-2,2'-disulfonate (VII-4): disodium 4,4'-bis[2,6-di(benzimidazolyl-2-thio)-pyrimidin-4-ylamino]stilbene-2,2'-disulfonate (VII-5): disodium 4,4'-bis[2-chloro-6-(2-naphthyloxy)-pyrimidin-4-ylamino]biphenyl-2,2'-disulfonate (VII-6): disodium 4,4'-bis[2,6-di(naphthyl-2-oxy)pyrimidin-4-ylamino]stilbene-2,2'-disulfonate (VII-7): disodium 4,4'-bis[2,6-di(naphthyl-2-oxy)pyrimidin-4-ylamino]bibenzyl-2,2'-disulfonate (VII-8): disodium 4,4'-bis(2,6-diphenoxypyrimidin-4-ylamino)stilbene-2,2'-disulfonate (VII-9): disodium 4,4'-bis(2,6-diphenylthiopyrimidin-4-ylamino)stilbene-2,2'-disulfonate (VII-10): disodium 4,4'-bis(2,6-dichloropyrimidin-4-ylamino)stilbene-2,2'-disulfonate (VII-11): disodium 4,4'-bis(2,6-dianilinopyrimidin-4-ylamino)stilbene-2,2'-disulfonate (VII-12): disodium 4,4 -bis[4,6-di(naphthyl-2-oxy)triazin-2-ylamino]stilbene-2,2'-disulfonate (VII-13): disodium 4,4'-bis(4,6-dianilinotriazin-2-ylamino)stilbene-2,2'-disulfonate (VII-14): disodium 4,4'-bis(2,6-dimercaptpyrimidin-4-ylamino)biphenyl-2,2'-disulfonate (VII-15): disodium 4,4'-bis[4,6-di(naphthyl-2-oxy)-pyrimidin-2-ylamino]stilbene-2,2'-disulfonate (VII-16): disodium 4,4'-bis[4,6-di(benzothiazolyl-2-thio)pyrimidin-2-ylamino]stilbene-2,2'-disulfonate (VII-17): disodium 4,4'-bis[4,6-di(1-phenyltetrazolyl-2-amino)pyrimidin-2-ylamino]stilbene-2,2'-disulfonate (VII-18): disodium 4,4'-bis[4,6-di(naphthyl-2-oxy)-pyrimidin-2-ylamino]bibenzyl-2,2'-disulfonate With respect to the order of the addition of the present red-sensitive sensitizing dye and compound (VII), the red-sensitive sensitizing dye or compound (VII) may be added first, or both of them may be added simultaneously. The present red-sensitive sensitizing dye and compound (VII) may be added in the form of a solution of their mixture.

The amount of the compound (VII) to be added is generally in the range of $1\times10^{-6}$ to $1\times10^{-1}$ mol/mol of the silver halide, and preferably $5\times10^{-5}$ to $1\times10^{-2}$ mol/mol of the silver halide. A preferable molar ratio between the present red-sensitive sensitizing dye to be added and compound (VII) can be chosen within the range of 1/50 to 10/1.

Steps of the production of the silver halide emulsion are roughly classified into a grain-formation step, a desalting step, a chemical-sensitizing step, a coating step, etc. The formation of grains includes the formation of nuclei, the ripening of the grains, the growing of the grains, etc. The order of these steps is not set, but this order may be reversed, and the steps may be repeated. The reduction sensitization may be carried out in the initial stage of the formation of grains, that is, at the time of the formation of nuclei of grains, or at the time of physical ripening of grains, or at the time of growth of grains, or prior to or after the chemical sensitization. If the chemical sensitization is carried out simultaneously with gold sensitization, it is preferable that the reduction sensitization is carried out prior to the chemical sensitization so as not to cause unpreferable fogging.

In the present invention, reduction sensitization may be chosen from a process wherein a known reducing agent is added to the silver halide emulsion, a process wherein grains are grown or ripened in an atmosphere of a low pAg of 1 to 7, which is called silver ripening, or a process wherein grains are grown or ripened in an atmosphere of a pH of 7 to 10, which is called high-pH ripening. Two or more of these processes may be used in combination.

The method wherein a reduction sensitizer is added is a preferable method, because the level of the reduction sensitization can be controlled delicately.

As the reduction sensitizer, stannous salts, amines, polyamines, hydrazine derivatives, formamidinesulfinic acid, silane compounds, and borane compounds are known. Ascorbic acids and their derivatives are also useful as reduction sensitizers. These compounds can be chosen for the present invention, and two or more of these compounds can be used in combination. As the reduction sensitizer, stannous chloride, thiourea dioxide, dimethylamine borane, or ascorbic acids and their derivatives are preferable compounds. Since the amount of the reduction sensitizer to be added depends on the conditions of the production of the emulsion, it is required to choose the amount to be added, and it is suitable to choose the amount to be added in the range of $10^{-7}$ to $10^{-2}$ per mol of the silver halide.

The reduction sensitizer may be dissolved in a solvent, such as water, an alcohol, a glycol, a ketone, an ester, and an amide, and the solution can be added during the formation of grains, or before or after the chemical sensitization. Although the reduction sensitizer can be added in any stage of the production of the emulsion, particularly preferably it is added during the growth of grains, or before or immediately after the chemical sensitization. Although the reduction sensitizer may be added previously into the reactor, preferably it is added at a suitable time of the formation of grains. Alternatively, the reduction sensitizer may be added previously to an aqueous silver salt solution or an aqueous solution of a water-soluble alkali halide, and by using these aqueous solutions, grains may be formed. It is also preferable that along with the formation of grains, a solution of the reduction sensitizer may be added in portions or continuously over a long period of time.

As specific examples of ascorbic acids and their derivatives (hereinafter referred to as ascorbic acid compounds), the following can be mentioned:

(A-1) L-ascorbic acid
(A-2) L-ascorbic acid sodium salt
(A-3) L-ascorbic acid potassium salt
(A-4) DL-ascorbic acid
(A-5) D-ascorbic acid sodium salt
(A-6) L-ascorbic acid-6-acetate
(A-7) L-ascorbic acid-6-palmitate
(A-8) L-ascorbic acid-6-benzoate
(A-9) L-ascorbic acid-6-diacetate
(A-10) L-ascorbic acid-5,6-o-isopropylidene Preferably at least one compound chosen from the group consisting of compounds represented by the following formulae (VII), (IX), and (X) is added to the silver halide emulsion of the present invention that has been subjected to reduction sensitization, because the change of sensitivity of the photographic material over time can be further prevented.

$$R—SO_2S—M \quad \text{(VIII)}$$

$$R—SO_2S—R^1 \quad \text{(IX)}$$

$$R—SO_2S—L_m—SO_2S—R^2 \quad \text{(X)}$$

wherein

R, $R^1$, and $R^2$, which may be the same or different, each represent an aliphatic group, an aromatic group, or a heterocyclyl group, M represents a cation, L represents a divalent linking group, and m is 0 or 1.

The compounds of formulae (VIII), (IX), and (X) will be further described in more detail. When R, $R^1$, and $R^2$ each represent an aliphatic group, preferably the aliphatic group is an alkyl group having 1 to 22 carbon atoms, or an alkenyl group or an alkynyl group having 2 to 22 carbon atoms which may be substituted. The alkyl group includes, for example, a methyl group, an ethyl group, a propyl group, a butyl group, a pentyl group, a hexyl group, an octyl group, a 2-ethylhexyl group, a decyl group, a dodecyl group, a hexadecyl group, an octadecyl group, a cyclohexyl group, an isopropyl group and t-butyl group.

The alkenyl group includes, for example, an allyl group and a butenyl group.

The alkynyl group includes, for example, a propargyl group and a butynyl group.

The aromatic group represented by R, $R^1$, and $R^2$ is one preferably having 6 to 20 carbon atoms such as a phenyl group and a naphthyl group, which may be substituted.

The heterocyclyl group represented by R, $R^1$, and $R^2$ is a 3- to 15-membered ring having at least one element selected from the group consisting of nitrogen, oxygen, sulfur, selenium and tellurium, such as a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tellurazole ring, a triazole ring, a benztriazole ring, a tetrazole ring, an oxadiazole ring, and a thiadiazole ring.

The substituent of R, $R^1$, and $R^2$ includes, for example, an alkyl group (e.g., methyl, ethyl, and hexyl), an alkoxy group (e.g., methoxy, ethoxy, and octyl), an aryl group (e.g., phenyl, naphthyl, and tolyl), a hydroxyl group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butylyl, and valeryl), a sulfonyl group (e.g., methylsulfonyl and phenylsulfonyl), an acylamino group (e.g., acetylamino and benzamino), a sulfonylamino group (e.g., methanesulfonylamino and benzenesulfonylamino), an acyloxy group (e.g., acetoxy and benzoxy), a carboxyl group, a cyano group, a sulfo group, and an amino group.

Preferably L represents a divalent aliphatic group or a divalent aromatic group. Examples of the divalent aliphatic group of L are, for example, $(CH_2)_n$ wherein n is 1 to 12, $—CH_2—CH=CH—CH_2—$, $—CH_2C\equiv CCH_2—$,

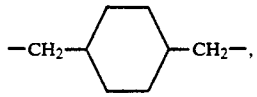

and a xylylene group. The divalent aromatic group of L includes, for example, a phenylene group and a naphthylene group.

These substituents may be further substituted by the substituents mentioned above.

Preferably M represents a metal ion or an organic cation. As the metal ion, a lithium ion, a sodium ion, and a potassium ion can be mentioned. As the organic cation, an ammonium ion (e.g., ammonium, tetramethylammonium, and tetrabutylammonium), a phosphonium ion (e.g., tetraphenylphosphonium), and a guanidyl group can be mentioned.

Specific examples of the compounds represented by formulae (VIII), (IX), or (X) are given below, but the present invention is not limited to them.

$CH_3SO_2SNa$ (VIII-1)

$C_2H_5SO_2SNa$ (VIII-2)

$C_3H_5SO_2SK$ (VIII-3)

$C_4H_9SO_2SLi$ (VIII-4)

$C_6H_{13}SO_2SNa$ (VIII-5)

$C_8H_{17}SO_2SNa$ (VII-6)

-continued
$CH_3(CH_2)_3CH(C_2H_5)CH_2SO_2S.NH_4$ (VIII-7)
$C_{10}H_{21}SO_2SNa$ (VIII-8)
$C_{12}H_{25}SO_2SNa$ (VIII-9)
$C_{16}H_{33}SO_2SNa$ (VIII-10)
$(CH_3)_2CH-SO_2SK$ (VIII-11)
$t\text{-}C_4H_9SO_2SNa$ (VIII-12)
$CH_3OCH_2CH_2SO_2S.Na$ (VIII-13)
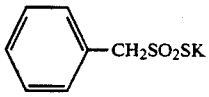
(VIII-14)
$CH_2{=}CHCH_2SO_2SNa$ (VIII-15)
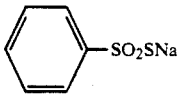
(VIII-16)
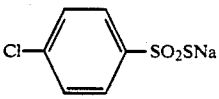
(VIII-17)
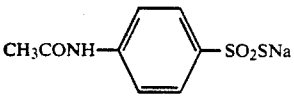
(VIII-18)
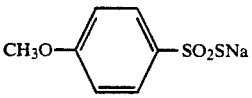
(VIII-19)
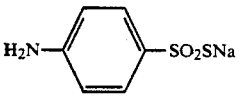
(VIII-20)
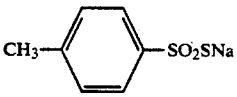
(VIII-21)
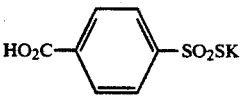
(VIII-22)
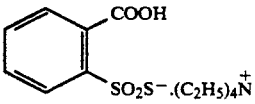
(VIII-23)
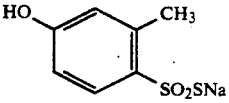
(VIII-24)
-continued
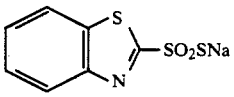
(VIII-25)
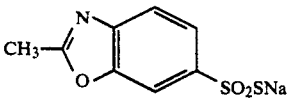
(VIII-26)
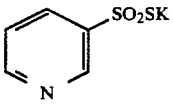
(VIII-27)
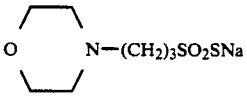
(VIII-28)
$C_2H_5SO_2S-CH_3$ (IX-1)
$C_8H_{17}SO_2SCH_2CH_3$ (IX-2)
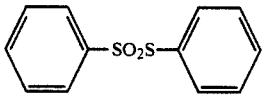
(IX-3)
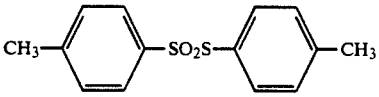
(IX-4)
$C_2H_5SO_2SCH_2CH_2CN$ (IX-5)
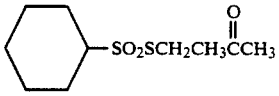
(IX-6)
$C_4H_9SO_2SCH(CH_3)CH_2CN$ (IX-7)
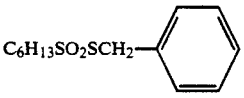
(IX-8)
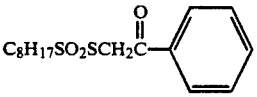
(IX-9)
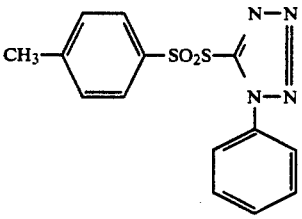
(IX-10)
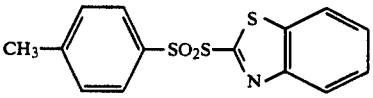
(IX-11)

-continued (IX-12)

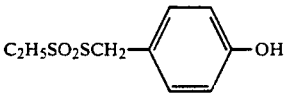

(IX-13)

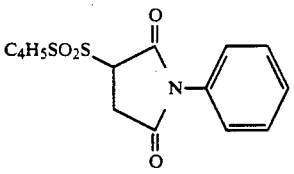

(IX-14)

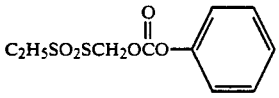

(IX-15)

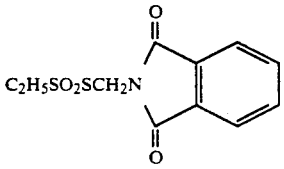

(IX-16)

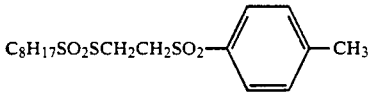

(IX-17)

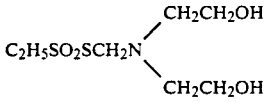

(IX-18)

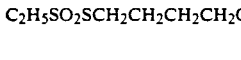

(IX-19)

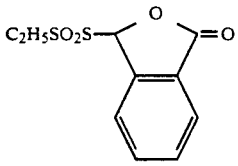

(IX-20)

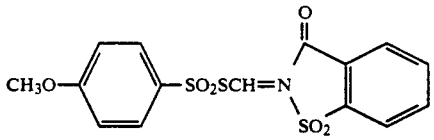

(X-1)

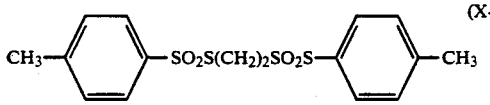

(X-2)

(X-3)

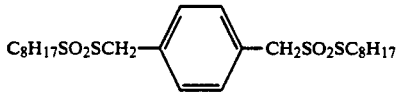

(X-4)

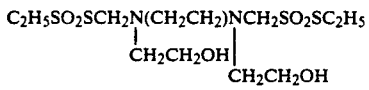

-continued (X-5)

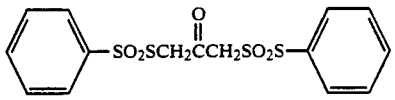

(X-6)

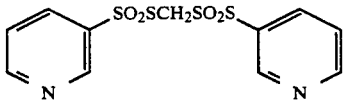

The compounds of formula (VIII) can be synthesized easily according the processes described in JP-A No. 1019/1974 and British Patent No. 972,211.

Preferably the compound represented by formula (VIII), (IX), or (X) is added in an amount of $10^{-7}$ to $10^{-1}$ mol per mol of the silver halide, more preferably $10^{-6}$ to $10^{-2}$, and particularly preferably $10^{-5}$ to $10^{-3}$ mol/mol of Ag.

To add the compound represented by formula (VIII), (IX), or (X) during the stage of production, use is made of a method generally used when additives are added to photographic emulsions. For example, in the case of a water-soluble compound, it is made into an aqueous solution having a suitable concentration, and the solution is added, while in the case of a compound insoluble or sparingly soluble in water, the compound is dissolved in a suitable organic solvent that is miscible with water, such as an alcohol, a glycol, a ketone, an ester, or an amide, which organic solvent will not adversely affect the photographic performance, and the solution is added.

The compound represented by formula (VIII), (IX), or (X) may be added at any stage during the formation of the grains of the silver halide emulsion, or before or after the chemical sensitization. Preferably the compound is added before or during the reduction sensitization.

Although the compound may be added into the reactor, preferably the compound is added at a suitable time during the formation or chemical sensitization of grains. It is also possible that the compound of formulae (VIII) to (X) can be previously added to an aqueous solution of a water-soluble alkali halide or a water-soluble silver salt, and grains may be formed using the aqueous solution. Also preferably along with the formation of grains, a solution of the compound of formulae (VIII) to (X) is added in portions or continuously over a long period of time.

The most preferable compound for the present invention is a compound represented by formula (VIII).

When the present invention is applied to a color photographic material, generally a yellow coupler, a magenta coupler, and a cyan coupler, which will couple with the oxidation product of an aromatic color developing agent to form yellow, magenta, and cyan respectively, are used in the color photographic material.

Cyan couplers, magenta couplers, and yellow couplers preferably used in the present invention are those represented by the following formulae (C-I), (C-II), (M-I), (M-II), and (Y):

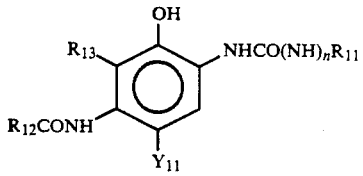

Formula (C-I)

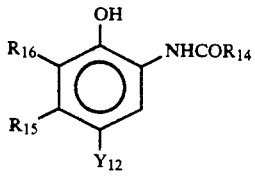

Formula (C-II)

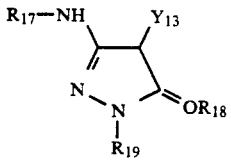

Formula (M-I)

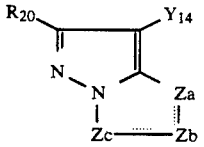

Formula (M-II)

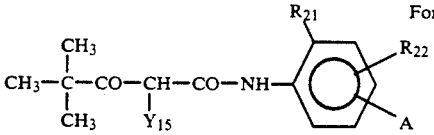

Formula (Y)

In formulae (C-I) and (C-II), $R_{11}$, $R_{12}$, and $R_{14}$ each represent a substituted or unsubstituted aliphatic, aromatic, or heterocyclic group, $R_{13}$, $R_{15}$, and $R_{16}$ each represent a hydrogen atom, a halogen atom, an aliphatic group, an aromatic group, or an acylamino group, $R_{13}$ and $R_{12}$ together may represent a group of nonmetallic atoms to form a 5- or 6-membered ring, $Y_{11}$ and $Y_{12}$ each represent a hydrogen atom or a group that is capable of coupling off with the oxidation product of a developing agent, and n is 0 or 1.

In formula (C-II), $R_{15}$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_{11}$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_{13}$ and $R_{12}$ together do not form a ring, $R_{12}$ is preferably a substituted or unsubstituted alkyl group, or aryl group, and particularly preferably an alkyl group substituted by a substituted aryloxy, and preferably $R_{13}$ represents a hydrogen atom.

In formula (C-II), preferable $R_{14}$ is a substituted or unsubstituted alkyl group or aryl group, and particularly preferably an alkyl group substituted by a substituted aryloxy group.

In formula (C-II), preferable $R_{15}$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_{15}$ is an alkyl group having 2 to 15 carbon atoms, and particularly preferably an alkyl group having 2 to 4 carbon atoms.

In formula (C-II), preferable $R_{16}$ is a hydrogen atom or a halogen atom, and particularly preferably a chlorine atom or a fluorine atom. In formulae (C-I) and (C-II), preferable $Y_{11}$ and $Y_{12}$ each represent a hydrogen atom, a halogen atom, an alkoxy group, an aryloxy group, an acyloxy group, or a sulfonamido group.

In formula (M-I), $R_{17}$ and $R_{19}$ each represent an aryl group, $R_{18}$ represents a hydrogen atom, an aliphatic or aromatic acyl group, an aliphatic or aromatic sulfonyl group, and $Y_{13}$ represents a hydrogen atom or a coupling split-off group. Allowable substituents of the aryl group represented by $R_{17}$ and $R_{19}$ are the same substituents as those allowable for the substituent $R_{11}$, and if there are two substituents, they may be the same or different. $R_{18}$ is preferably a hydrogen atom, an aliphatic acyl group, or a sulfonyl group, and particularly preferably a hydrogen atom. Preferable $Y_{13}$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{20}$ represents a hydrogen atom or a substituent. $Y_{14}$ represents a hydrogen atom or a coupling split-off group, and particularly preferably a halogen atom or an arylthio group. Za, Zb, and Zc each represent methine, a substituted methine, =N—, or —NH—, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{20}$ or $Y_{14}$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{21}$ represents a halogen atom, an alkoxy group, a trifluoromethyl group, or an aryl group, and $R_{22}$ represents a hydrogen atom, a halogen atom, or an alkoxy group. A represents —$NHCOR_{23}$, —$NHSO_2$—$R_{23}$, —$SO_2NHR_{23}$, —$COOR_{23}$, or $$-SO_2\underset{\underset{R_{24}}{|}}{N}-R_{23},$$

wherein $R_{23}$ and $R_{24}$ each represent an alkyl group, an aryl group, or an acyl group. $Y_{15}$ represents a coupling split-off group. Substituents of $R_{22}$, $R_{23}$, and $R_{24}$ are the same as those allowable for $R_{11}$, and the coupling split-off group $Y_{15}$ is of the type that will split off preferably at an oxygen atom or a nitrogen atom, and particularly preferably it is of the nitrogen atom split-off type.

Specific examples of couplers represented by formulae (C-I), (C-II), (M-I), (M-II), and (Y) are listed below.

(C-1)

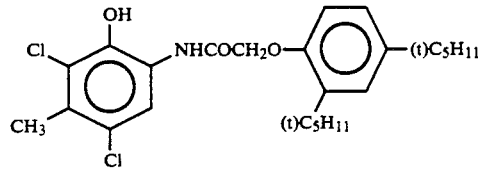

(C-2)

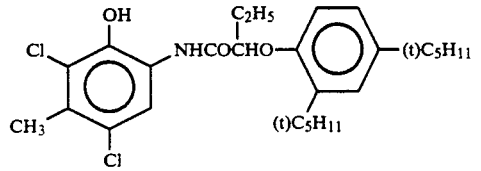

(C-3)

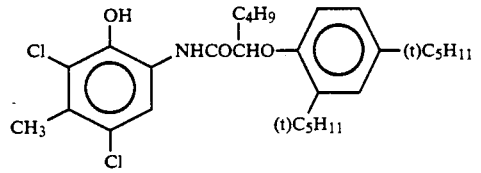

(C-4)

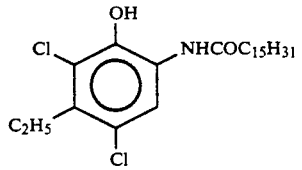

(C-5)

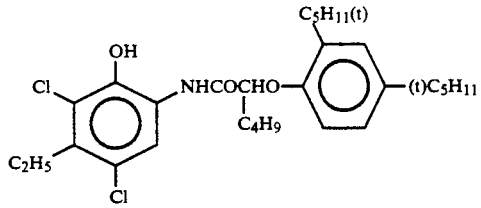

(C-6)

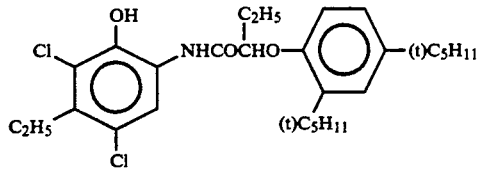

(C-7)

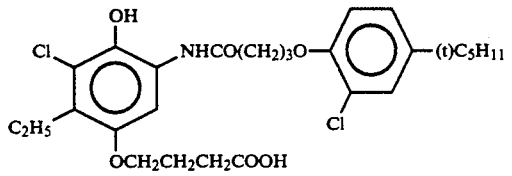

-continued
(C-8)
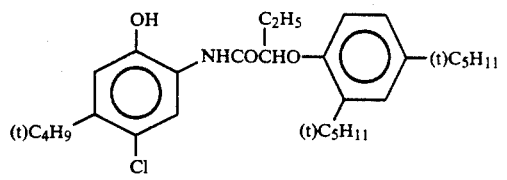
(C-9)
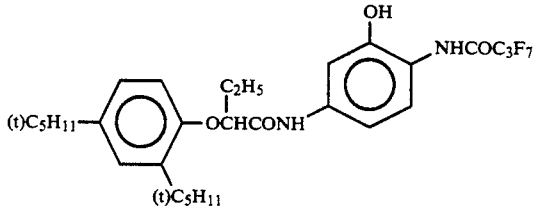
(C-10)
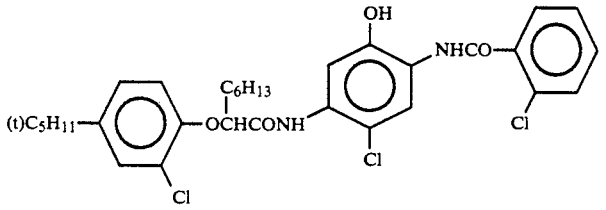
(C-11)
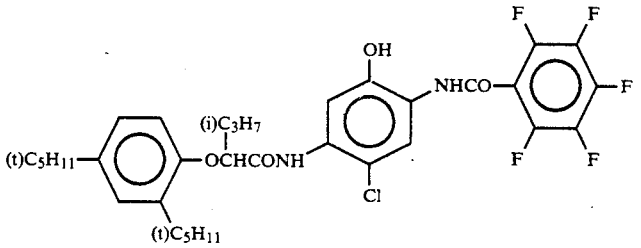
(C-12)
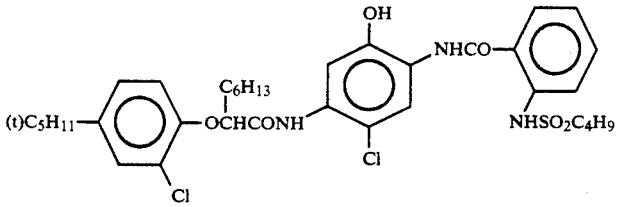
(C-13)
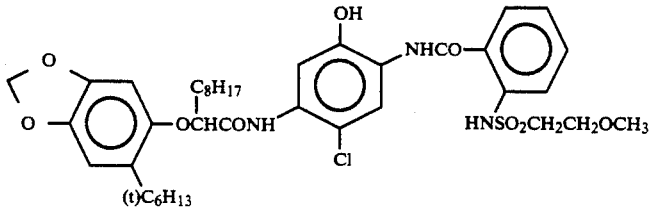
(C-14)
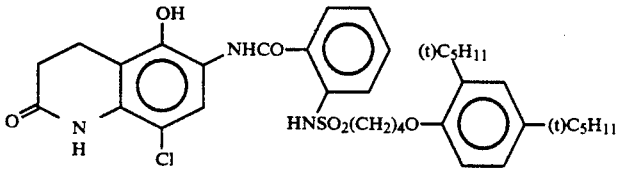

-continued
(C-15)
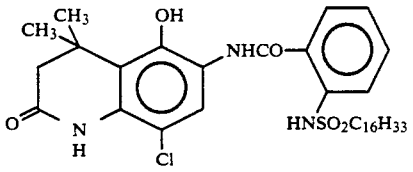
(C-16)
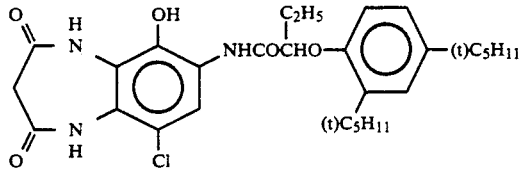
(C-17)
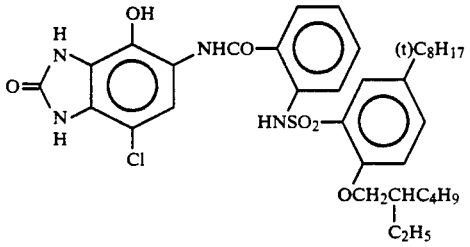
(C-18)
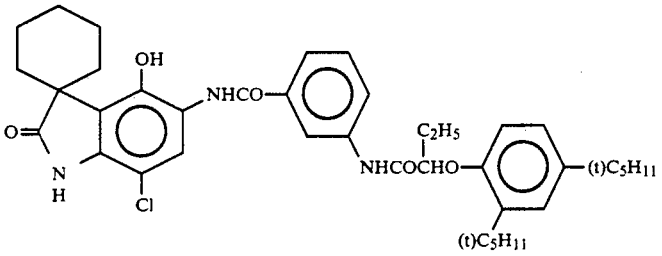
(C-19)
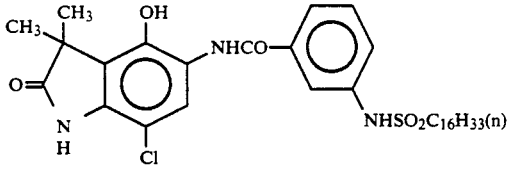
(C-20)
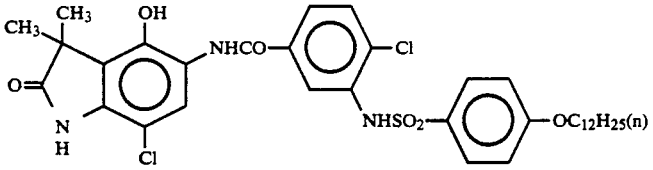
(C-21)
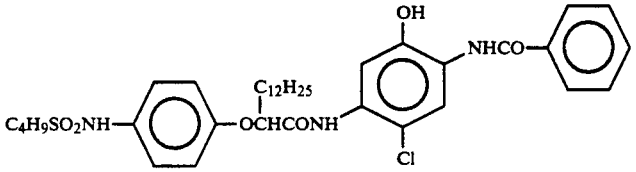

-continued
(C-22)
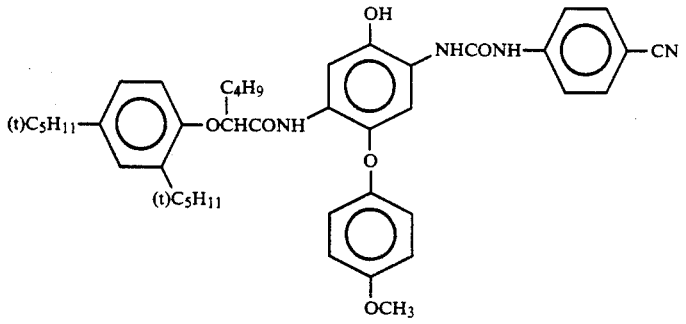
(M-1)
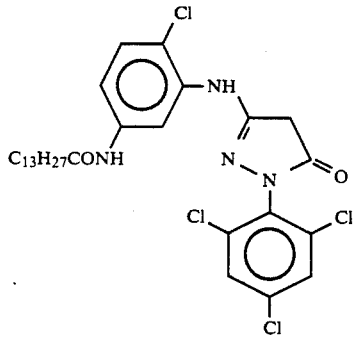
(M-2)
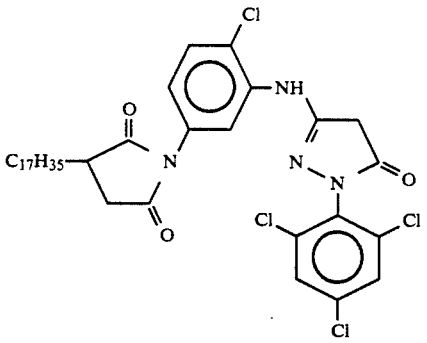
(M-3)
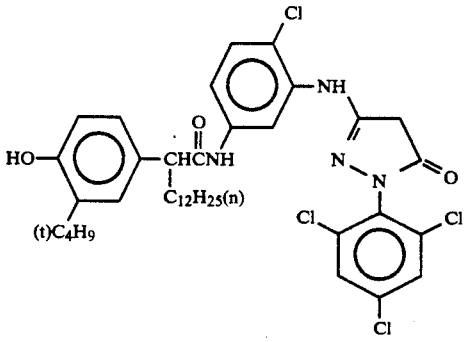

-continued
(M-4)
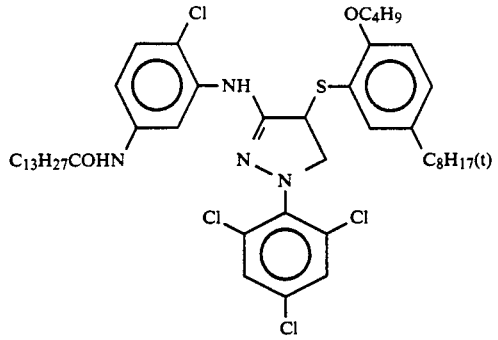
(M-5)
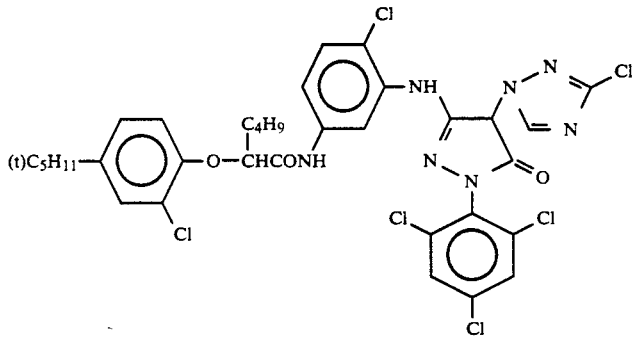
(M-6)
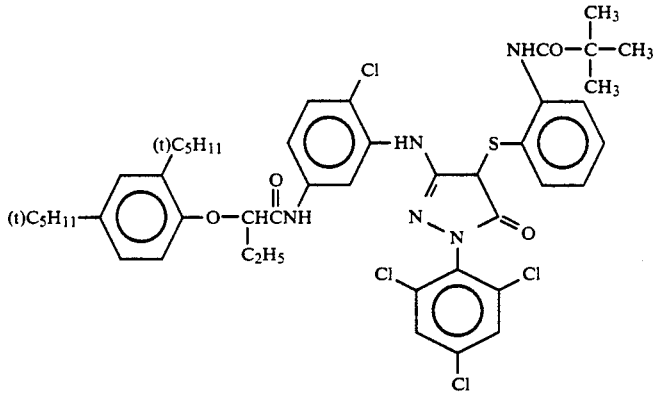
(M-7)
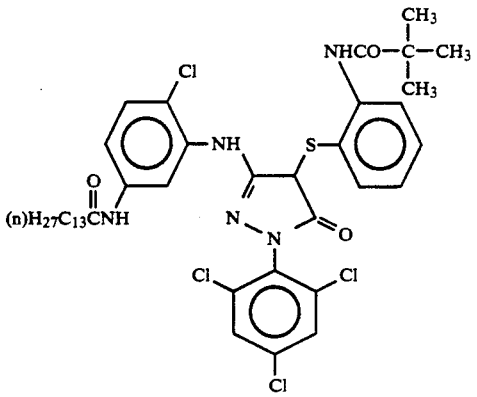

-continued
(M-8)
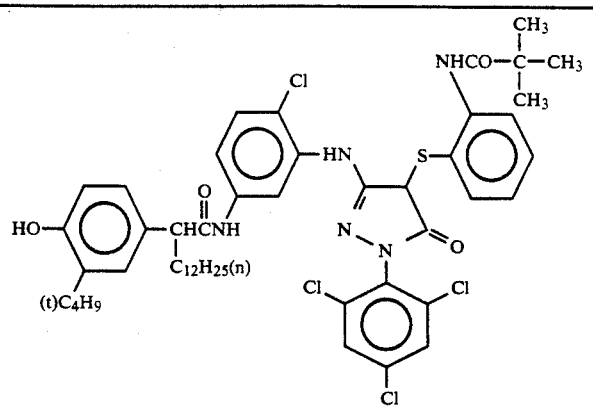
| Compound | $R_{10}$ | $R_{15}$ | $Y_4$ |
|---|---|---|---|
| | | 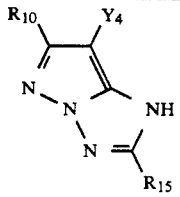 | |
| M-9 | $CH_3$— | 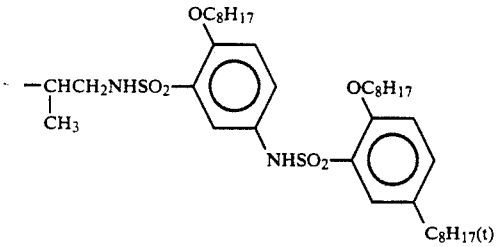 | Cl |
| M-10 | The same as the above | 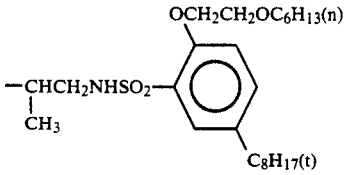 | The same as the above |
| M-11 | $(CH_3)_3C$— | 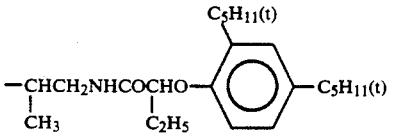 | 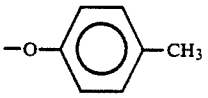 |
| M-12 | 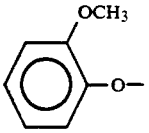 | 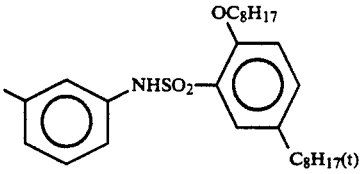 | 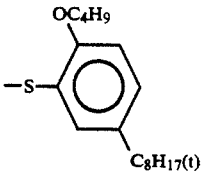 |
| M-13 | $CH_3$— | 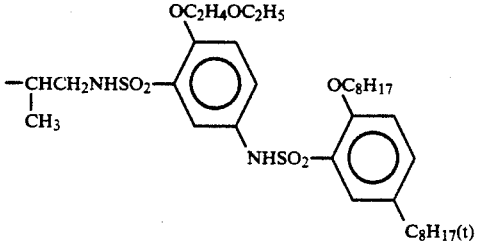 | Cl |

-continued
| | | | |
|---|---|---|---|
| M-14 | The same as the above | 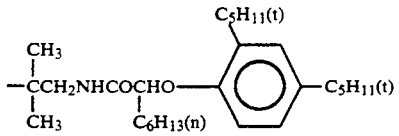 | The same as the above |
| M-15 | The same as the above | 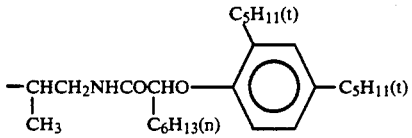 | The same as the above |
| M-16 | The same as the above | 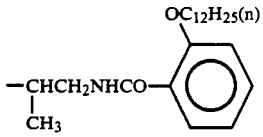 | The same as the above |
| M-17 | The same as the above | 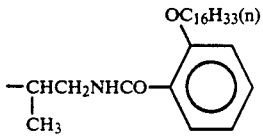 | The same as the above |
| M-18 | 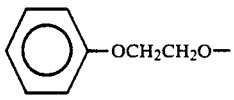 | 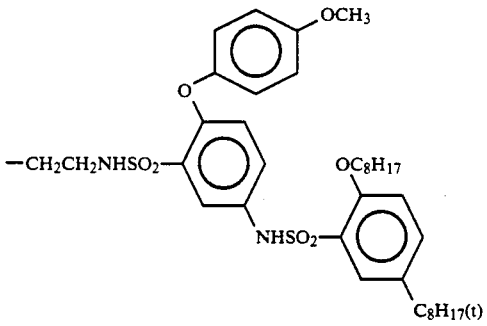 | 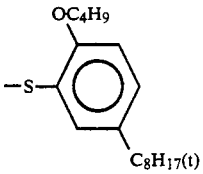 |
| M-19 | $CH_3CH_2O-$ | The same as the above | The same as the above |
| M-20 | 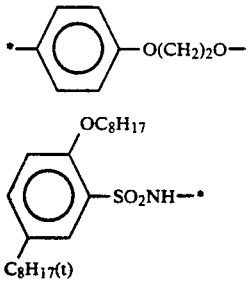 | 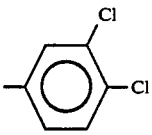 | 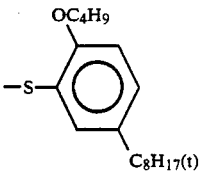 |
| M-21 | 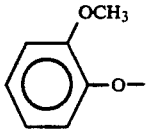 | 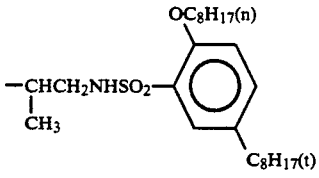 | Cl |
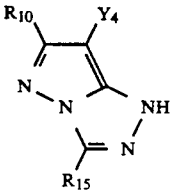

-continued
| | | | |
|---|---|---|---|
| M-22 | $CH_3$— | 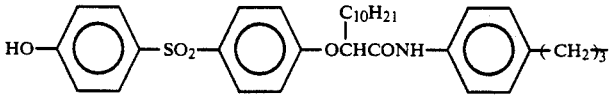 | Cl |
| M-23 | The same as the above | 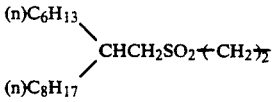 | The same as the above |
| M-24 | 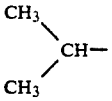 | 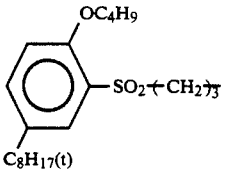 | The same as the above |
| M-25 | 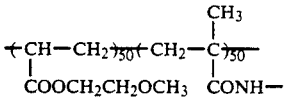 | 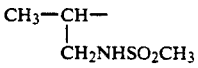 | The same as the above |
| M-26 | 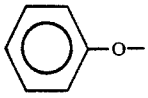 | 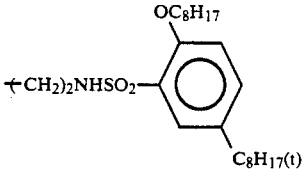 | The same as the above |
| M-27 | $CH_3$— | 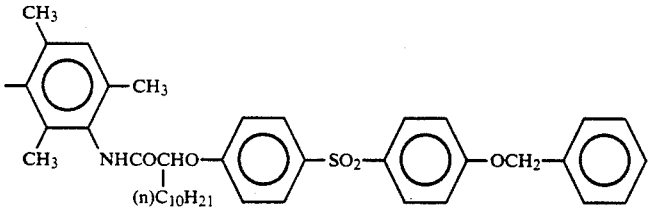 | Cl |
| M-28 | $(CH_3)_3C$— | 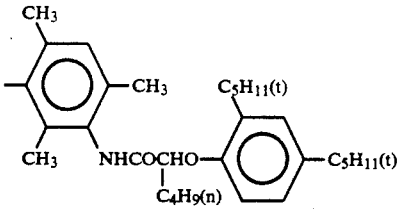 | The same as the above |
| M-29 | 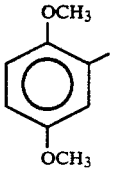 | 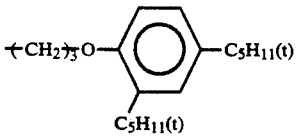 | The same as the above |
| M-30 | $CH_3$— | 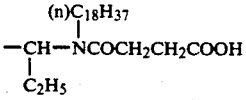 | The same as the above |

-continued
(Y-1)
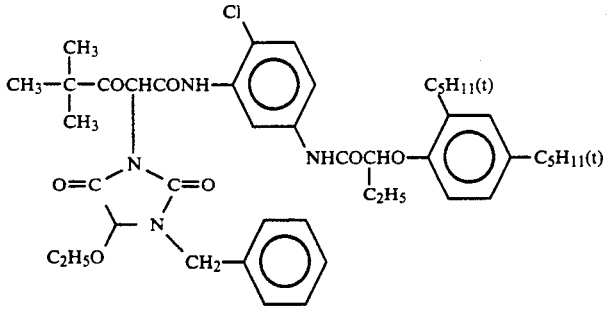
(Y-2)
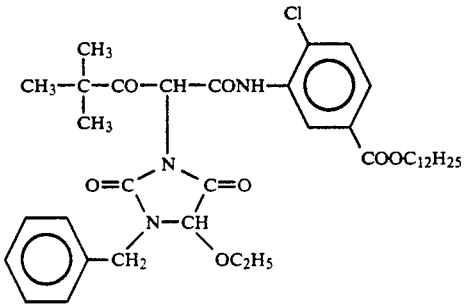
(Y-3)
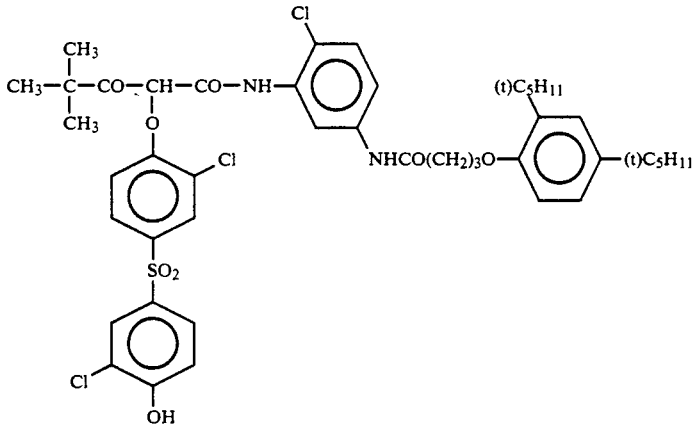
(Y-4)
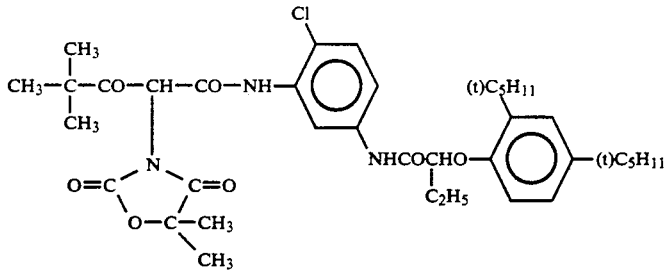
(Y-5)
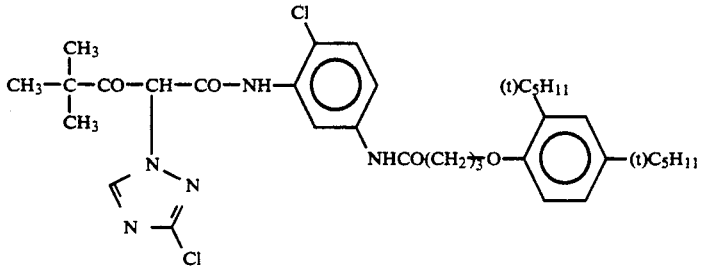

-continued (Y-6)

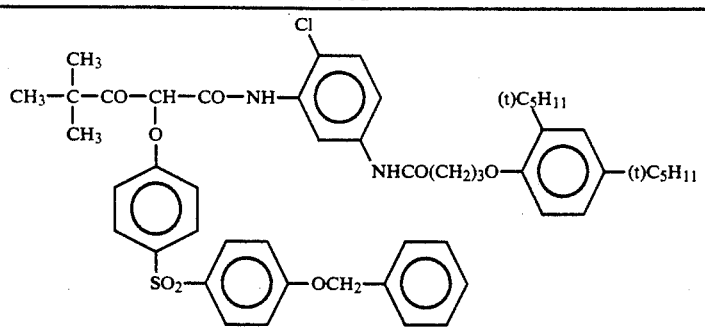

(Y-7)

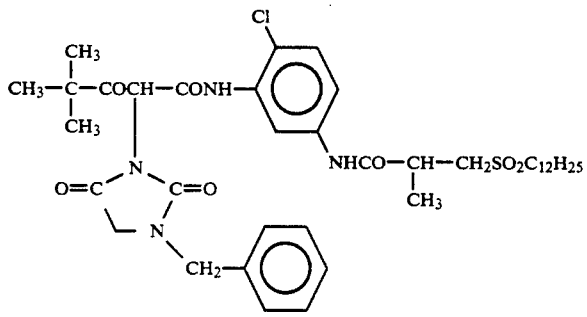

(Y-8)

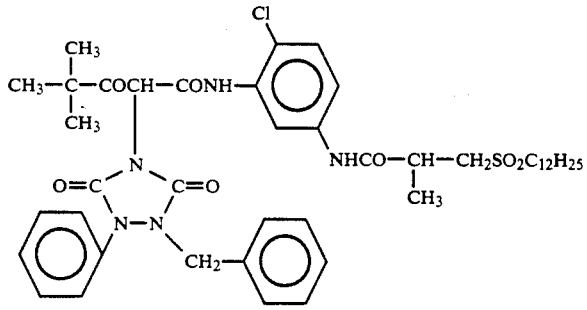

(Y-9)

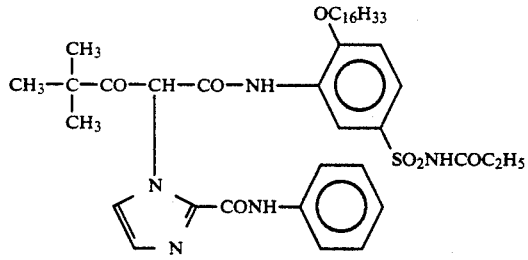

The coupler represented by formulae (C-I) to (Y) is contained in a silver halide emulsion layer constituting a photosensitive layer generally in an amount of 0.1 to 1.0 mol, preferably 0.1 to 0.5 mol, per mol of the silver halide.

In the present invention, to add the coupler to a photosensitive layer, various techniques can be applied. Generally, the coupler can be added by the oil-in-water dispersion method, known as the oil-protect method, wherein after the coupler is dissolved in a solvent, it is emulsified and dispersed into an aqueous gelatin solution containing a surface-active agent. Alternatively, water or an aqueous gelatin solution may be added into a solution of the coupler that contains a surface-active agent, to form an oil-in-water dispersion with phase reversal of the emulsion. In the case of alkali-soluble couplers, they can be dispersed by the so-called Fischer dispersion method. It is also possible that the low-boiling organic solvent is removed from the coupler dispersion by, for example, distillation, noodle washing, or ultrafiltration, and then the dispersion is mixed with a photographic emulsion.

As the dispersion medium for such couplers, water-insoluble polymeric compounds and/or high-boiling organic solvents having a dielectric constant of 2 to 20 (25° C.) and a refractive index of 1.5 to 1.7 (25° C.) are preferably used.

As the high-boiling organic solvent, a high-boiling organic solvent represented by the following formula (A'), (B'), (C'), (D'), or (E') is preferably used.

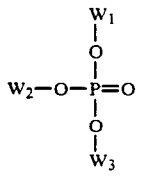

Formula (A')

$W_1—COO—W_2$ Formula (B')

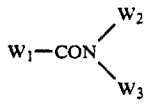

Formula (C')

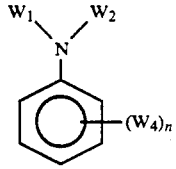

Formula (D')

$W_1—O—W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or S-$W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column)

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol·sec to $1\times10^{-5}$ l/mol·sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{31}-(A)_n-X_{31} \qquad \text{(FI)}$$

$$R_{32}-\underset{\underset{B}{|}}{C}=Y_{31} \qquad \text{Formula (FII)}$$

wherein $R_{31}$ and $R_{32}$ each represent an aliphatic group, an aromatic group, or a heterocyclic group, n is 1 or 0, A represents a group that will react with an aromatic amine developing agent to form a chemical bond therewith, $X_{31}$ represents a group that will react with the aromatic amine developing agent and split off, B represents a hydrogen atom, an aliphatic group, an aromatic group, a heterocyclic group, an acyl group, or a sulfonyl group, $Y_{31}$ represents a group that will facilitate the addition of the aromatic amine developing agent to the compound represented by formula (FII), and $R_{31}$ and $X_{31}$, or $Y_{31}$ and $R_{32}$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{41}-Z_{41} \qquad \text{(GI)}$$

wherein $R_{41}$ represents an aliphatic group, an aromatic group, or a heterocyclic group, $Z_{41}$ represents a nucleophilic group or a group that will decompose in the photographic material to release a nucleophilic group. Preferably the compounds represented by formula (GI) are ones wherein $Z_{41}$ represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\bar{R}$, wherein s stands for the standard deviation of Ri, and $\bar{R}$ stands for the average value of Ri. Preferably, the number (n) of the unit areas to be subjected is 6 or over. Therefore, the deviation coefficient $s/\bar{R}$ can be obtained by $$\sqrt{\frac{\sum_{i=1}^{n}(R_i - R)^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]-aniline
D-6: 4-amino-3-methyl-N-ethyl-N-['-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0 \times 10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0 \times 10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hyirazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metal described, for example, in JP-A Nos. 44148/1982 and 3749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239477/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mol/l, it is not preferable that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids o their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8- octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

The preferable replenishing amount per unit area of photographic material is 0.5 to 50 times, more preferably 3 to 40 times amount of solution carried over from the preceding bath. In other words, it is 1 liter or below, preferably 500 ml or below, per square meter of photographic material. The replenishing may be carried out continuously or intermittently.

Solutions which used in washing process and/or stabilizing process can be used further in preceding process. Of this example it can be mentioned that the overflow of washing water which reduced by multi-stage counter current system is introduced to the preceding bleach-fixing bath and a concentrated solution is replenished into the bleach-fixing bath to reduce the waste solution.

The present invention can provide a silver halide photographic material that is excellent in rapid processability and high in sensitivity and wherein there is little change of photographic performance due to the passage of time or due to a change of the interval from exposure to light to processing.

Next, the present invention will be described in detail in accordance with examples, but the invention is not limited to these Examples.

EXAMPLE 1

32 g of lime-treated gelatin was added to 1,000 ml of distilled water and were dissolved therein at 40° C., then 3.3 g of sodium chloride was added and the temperature was increased to 60° C. 3.2 ml of a 1% aqueous solution of N,N'-dimethylimidazolidine-2-thion was added thereto. Then, a solution of 32.0 g of silver nitrate in 200 ml of distilled water and a solution of 11.0 g of sodium chloride in 200 ml of distilled water were added to the above solution and mixed over 8 min. with the temperature kept at 60° C. To this solution, a solution of 128.0 g of silver nitrate in 560 ml of distilled water and a solution of 44.0 g of sodium chloride in 560 ml of distilled water were added and mixed for 20 min. with the temperature kept at 60° C. After completion of the addition of the aqueous silver nitrate solution and the aqueous alkali halide solution, the temperature was decreased to 40° C., and desalting and washing with water were carried out. Then, after 90.0 g of lime-treated gelatin was added, and the pAg was adjusted to 7.2 using sodium chloride, 60.0 mg of red-sensitive sensitizing dye (S-1) and 2.0 mg of triethylthiourea were added, and the mixture was chemically sensitized optimally at 58° C. The thus obtained silver chloride emulsion was named emulsion A-1.

The above procedure was repeated, except that the red-sensitive sensitizing dye (S-1) added before the chemical sensitization was replaced with (I-22), thereby preparing an emulsion, which was named emulsion A-2.

The above procedure for emulsion A-1 was repeated, except that the ripening was carried out in such a manner that the reduction sensitizers shown in Table 1 were added in the amounts shown per mol of silver before the chemical sensitization, thereby preparing emulsions B-1, C-1, and D-1.

The procedure for emulsions B-1, C-1, and D-1 was repeated, except that the red-sensitive sensitizing dye (S-1) added before the reduction sensitization was replaced by (I-22), thereby preparing emulsions B-2, C-2, and D-2.

With respect to the thus obtained 8 silver halide emulsions A-1 to D-2, the shape of the grains, grain size, and grain size distribution were found from electronmicrographs, and all of them were 0.52 μm cubic grains having a deviation coefficient of 9%.

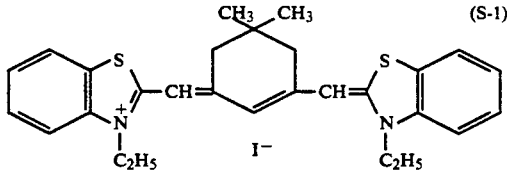

(S-1)

$E_R = -1.245V$

TABLE 1

| Emulsion | Reduction Sensitizer | Amount add per mol of silver |
|---|---|---|
| B - 1 | 2 - A | $1 \times 10^{-5}$ mol |
| C - 1 | 2 - B | $3 \times 10^{-6}$ mol |

TABLE 1-continued

| Emulsion | Reduction Sensitizer | Amount add per mol of silver |
|---|---|---|
| D - 1 | 2 - C | $1 \times 10^{-3}$ mol |

Note:
2 - A: Thiourea dioxyde
2 - B: Dimethylamine boran
2 - C: L-ascorbic acid

A multilayer photographic material was prepared by multi-coatings composed of the following layer composition on a two-side polyethylene laminated paper support Coating solutions were prepared as follows:

The Preparation of the First Coating Liquid 27.2 ml of ethyl acetate and 8.2 g of solvent (Solv-1) were added to 19.1 g of yellow coupler (ExY), 4.4 g of dye image stabilizer (Cpd-1), and 0.7 g of dye image stabilizer (Cpd-7) to dissolve them, and the solution was dispersed and emulsified into 185 ml of a 10% aqueous gelatin solution containing 8 ml of 10% dodecylbenzenesulfonic acid sodium salt. Additionally, a blue-sensitive sensitizing dye, described below, was added to silver chlorobromide emulsions (that were cubic and mixtures of an emulsion having an average grain size of 0.88 μm and an emulsion having an average grain size of 0.70 μm in a molar ratio of 3 to 7 in terms of silver; the deviation coefficients of the grain size distribution were 0.08 and 0.10 respectively, and each emulsion contained 0.2 mol % of silver bromide locally on the grain surface) in amounts of $2.0 \times 10^{-4}$ mol per mol of silver for the large-sized emulsion and $2.5 \times 10^{-4}$ mol per mol of silver for the small-sized emulsion, and then sulfur sensitization was carried out. The above emulsified dispersion and this emulsion were mixed and dissolved to prepare the first coating liquid, which had the following composition.

The coating liquids for the second layer to the seventh layer were prepared similarly to the first coating liquid. As a hardener in each layer, 1-oxy-3,5-dichloro-s-triazine sodium salt was used.

As spectrally sensitizing dye for each layer, the following were used:

Blue-sensitive emulaion layer

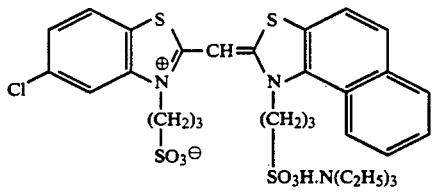

and

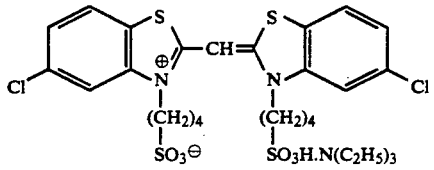

(each $2.0 \times 10^{-4}$ mol to the large size emulsion and $2.5 \times 10^{-4}$ mol to the small size emulsion, per mol of silver halide.)

Green-sensitive emulsion layer

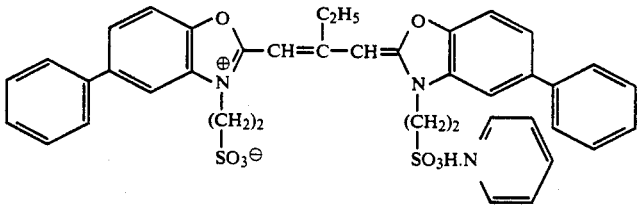

($4.0\times10^{-4}$ mol to the large size emulsion and $5.6\times10^{-4}$ mol to the small size emulsion, per mol of silver halide) and

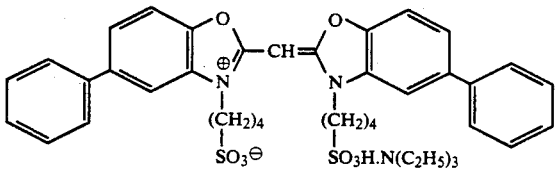

($7.0\times10^{-5}$ mol to the large size emulsion and $1.0\times10^{-5}$ mol to the small size emulsion, per mol of silver halide)

To the red-sensitive emulsion layer, the following compound was added in an amount of $2.6\times10^{-3}$ mol per mol of silver halide:

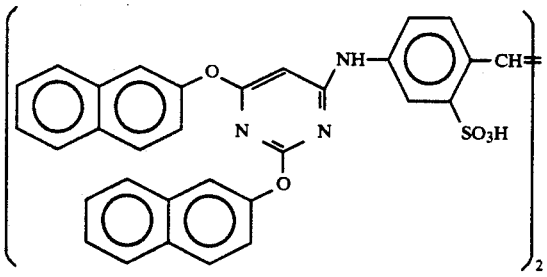

Further, 1-(5-methylureidophenyl)-5-mercapto-tetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

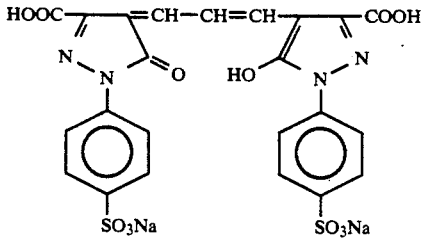

and

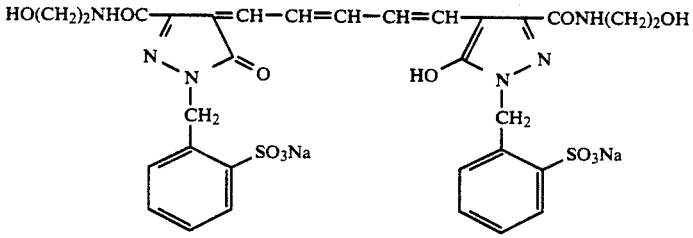

Composition of Layers

The composition of each layer is shown below. The figures represent coating amount ($g/m^2$). The coating amount of each silver halide emulsion is given in terms of silver.

Supporting Base

Paper laminated on both sides with polyethylene (a white pigment, Ti02, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |

-continued

| | |
|---|---|
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chloride emulsion A-1 | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |

-continued

| | |
|---|---|
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler
Mixture (1:1 in molar ratio) of

R = 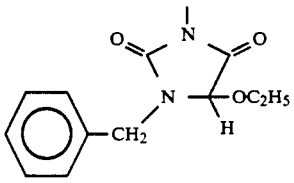 and R = 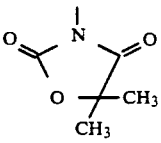 of the following formula

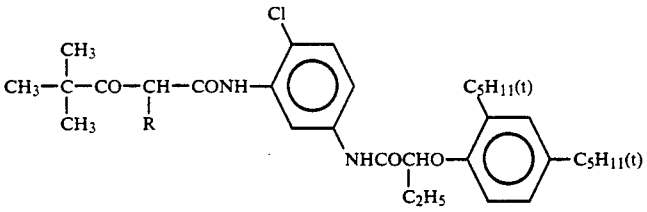

(ExM) Magenta coupler
Mixture (1:1 in molar ratio) of

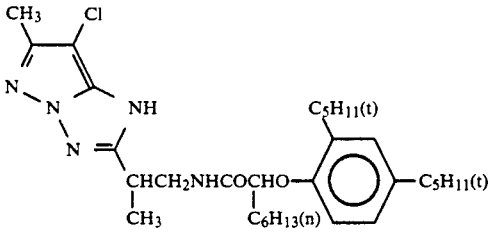 and 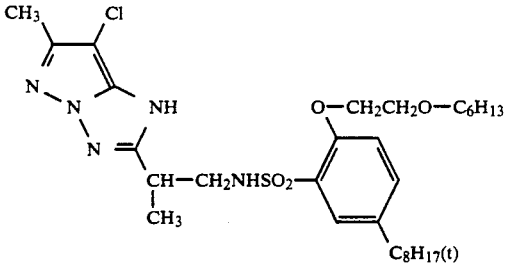

(ExC) Cyan coupler
Mixture (2:4:4 in weight ratio) of R = $C_2H_5$ and $C_4H_9$ of

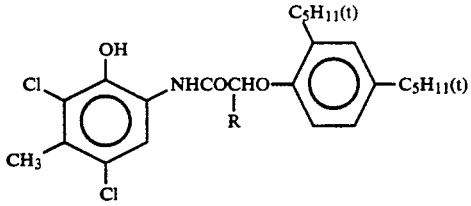 and 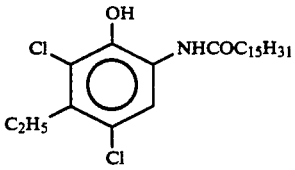

(Cpd-1) Image-dye stabilizer

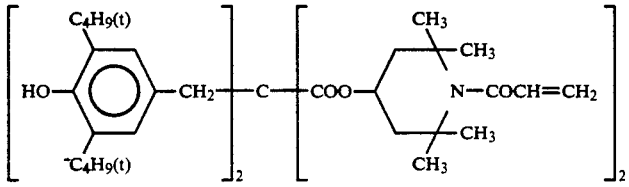

(Cpd-2) Image-dye stabilizer

-continued
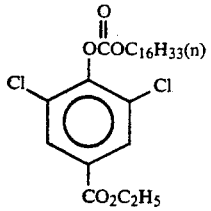
(Cpd-3) Image-dye stabilizer
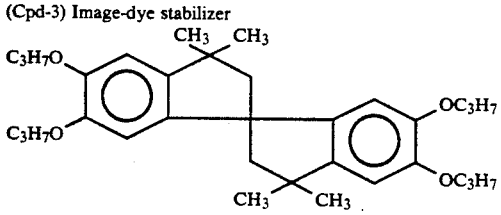
(Cpd-4) Image-dye stabilizer
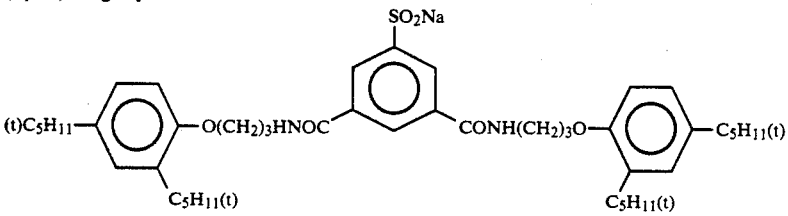
(Cpd-5) Color-mix inhibitor
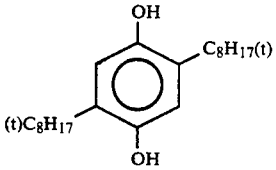
(Cpd-6) Image-dye stabilizer
Mixture (2:4:4 in weight ratio) of
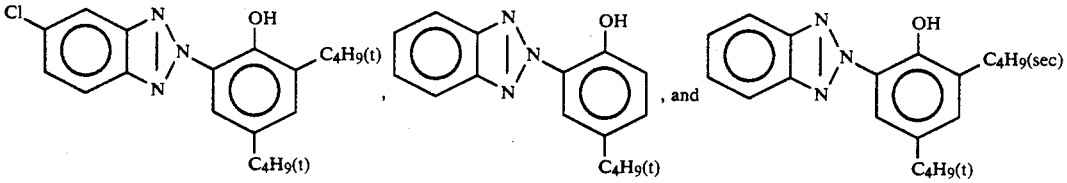
(Cpd-7) Image-dye stabilizer
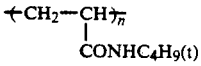
Average molecular weight: 60,000
(Cpd-8) Image-dye stabilizer
Mixture (1:1:1 in weight ratio) of
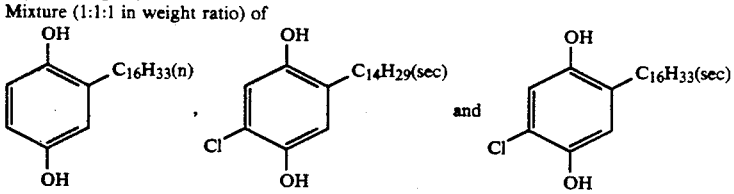
(Cpd-9) Image-dye stabilizer
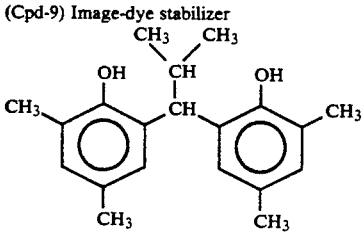

-continued (UV-1) Ultraviolet ray absorber
Mixture (4:2:4 in weight ratio) of

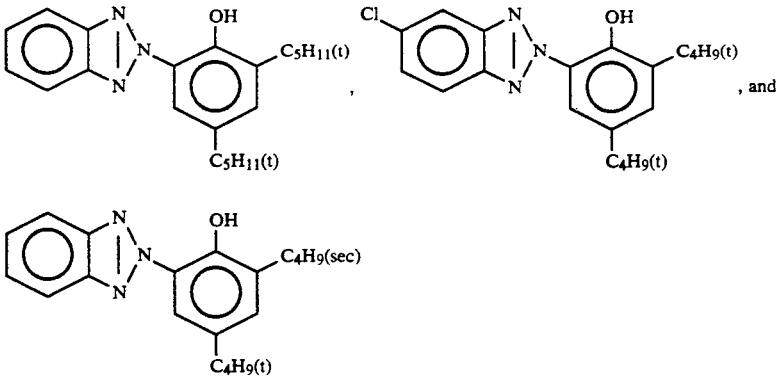

(Solv-1) Solvent

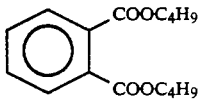

(Solv-2) Solvent

Mixture (2:1 in volume ratio) of

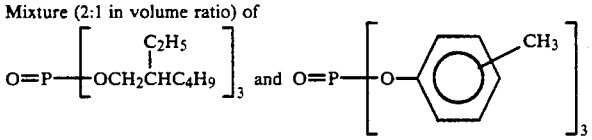

(Solv-3) Solvent

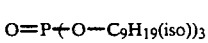

(Solv-4) Solvent

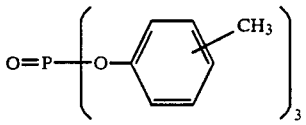

(Solv-5) Solvent

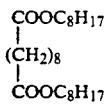

(Solv-6) Solvent

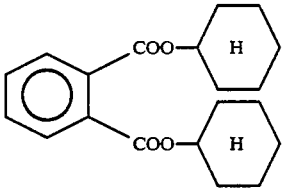

The photographic material obtained as above was named A-1.

The procedure for A-1 was repeated, except that only the silver chloride emulsion of the fifth layer (a red-sensitive layer) was replaced as shown in Table 2, thereby preparing photographic materials A-2, B-1, B-2, C-1, C-2, D-1, and D-2.

To examine the sensitivity of the thus obtained 8 photographic materials, they were exposed to light for 0.1 sec through an optical wedge and a red filter, and after 30 sec they were subjected to color development processing in the processing step and using the processing liquids given below. To examine the change of photographic performance (latent-image-keeping) due to a change of the interval from exposure of the photographic material to light to processing, the same processing as above was carried out with the period from exposure to light to processing being 5 hours. Further, to assess the amount of fluctuation of the photographic sensitivity due to natural storage, the photographic materials were kept for 1 month in an atmosphere of 40° C and 50 %RH, and then the photographic materials were exposed to light and processed in the same manner as above.

| Processing step | Temperature | Time |
|---|---|---|
| Color development | 35° C. | 45 sec |
| Bleach-fixing | 30 to 35° C. | 45 sec |
| Rinsing 1 | 30 to 35° C. | 20 sec |
| Rinsing 2 | 30 to 35° C. | 20 sec |
| Rinsing 3 | 30 to 35° C. | 20 sec |
| Drying | 70 to 80° C. | 60 sec |

The compositions of the processing liquid are shown below:

| Color developer | |
|---|---|
| Water | 800 ml |
| Ethylenediamine-N,N,N',N'-tetra-methylenephosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline sulfonate | 5.0 g |
| Fluorescent brightening agent WHITEX-4, made by Sumitomo Chemical Ind. Co.) | 1.0 g |
| Water to make | 1000 ml |
| pH (25° C.) | 10.55 |

-continued

| Bleach-fixing solution | |
|---|---|
| Water | 400 ml |
| Ammonium thiosulfate (70%) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonium bromide | 40 g |
| Water to make | 1000 ml |
| pH (25° C.) | 6.0 |

Rinsing liquid

Deionized water (the amounts of calcium and magnesium being 3 ppm or below respectively)

The reflection density of each of the thus processed samples was measured to obtain the characteristic curve. The sensitivity was defined as the reciprocal of the exposure amount required to give a density of 0.1, and was given as a relative value by assuming the sensitivity of sample A-1 to be 100.

To assess the latent-image-keeping, the density change ΔD (latent image) was obtained, which was given after 5 hours with the exposure amount that gave a density of 0.1 when processed 30 sec after exposure to light. To assess the fluctuation of the sensitivity due to storage, the density change ΔD (with time) was obtained, which was given by processing after the passage of 1 month with the exposure amount that gave a density of 1.0 when the sample was processed with no time passage.

The results are given in Table 2.

TABLE 2

| Sample | Red-sensitive sensitizing dye | Reduction sensitizer used in the red-sensitive emulsion | S[1)] | ΔD[2)] (latent image) | ΔD[3)] (with time) | Remarks |
|---|---|---|---|---|---|---|
| A - 1 | S - 1 | — | 100 | −0.06 | −0.15 | Comparative example |
| A - 2 | I - 22 | — | 107 | −0.07 | −0.12 | " |
| B - 1 | S - 1 | 2 - A | 158 | −0.05 | −0.17 | " |
| B - 2 | I - 22 | 2 - A | 208 | +0.01 | −0.04 | This invention |
| C - 1 | S - 1 | 2 - B | 141 | −0.05 | −0.16 | Comparative example |
| C - 2 | I - 22 | 2 - B | 186 | −0.01 | −0.05 | This invention |
| D - 1 | S - 1 | 2 - C | 174 | −0.04 | −0.13 | Comparative example |
| D - 2 | I - 22 | 2 - C | 229 | −0.02 | −0.04 | This invention |

[1)]Relative values are given by assuming the sensitivity of sample A - 1 to be 100. The greater the value is, the higher the sensitivity is.
[2)]A negative value indicates latent-image regression, while a positive value indicates latent-image sensitization. The smaller the absolute value is, the better the latent-image-keeping is.
[3)]A negative value indicates desensitization due to the passage of time, while a positive value indicates sensitization due to the passage of time. The smaller the absolute value is, the better the stability after the passage of time is.

(S-2)

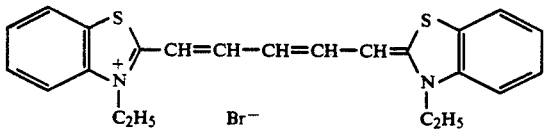

$E_R = -1.140$ V (S-3)

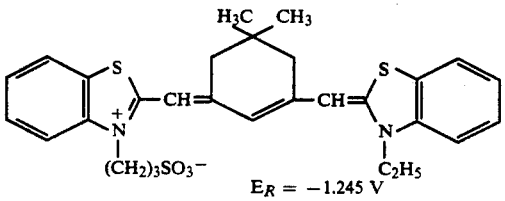

$E_R = -1.245$ V

As is apparent from the results shown in Table 2, it can be understood that the present photographic material is good in latent-image stability and high in sensitivity, and that there is little change in the sensitivity of the present photographic material after storage.

EXAMPLE 2

The procedure for preparing emulsion B-1 and B-2 in Example 1 was repeated, except that the red-sensitive sensitizing dye added before the reduction sensitization was replaced as shown in Table 3, thereby preparing emulsions B-3 to B-8. These emulsions were applied in the same manner as in Example 1, to form photosensitive materials B-3 to B-8, and the photographic performance was assessed The results are shown in Table 3.

TABLE 3

| Sample | Red-sensitive sensitizing dye | S[1)] | ΔD (latent image) | ΔD (with time) | Remarks |
|---|---|---|---|---|---|
| B - 3 | S - 2 | 100 | −0.06 | −0.13 | Comparative example |
| B - 4 | S - 3 | 182 | −0.05 | −0.10 | Comparative example |
| B - 5 | I - 3 | 240 | +0.01 | −0.04 | This invention |
| B - 6 | I - 5 | 204 | −0.02 | −0.05 | This invention |
| B - 7 | I - 8 | 263 | +0.01 | −0.03 | This invention |
| B - 8 | I - 18 | 240 | +0.01 | −0.04 | This invention |

[1)]Relative values are given by assuming the sensitivity of sample B - 3 to be 100.

From the results shown in Table 3, for the sensitizing dyes shown in Table 3, the same effect as that in Example 1 was confirmed.

EXAMPLE 3

The procedure for photographic material B-2 in Example 1 was repeated, except that the nitrogen-containing heterocyclic compound added in the emulsion layer was replaced as shown in Table 4, thereby preparing photographic materials B-9 to B-12.

The photographic performance of these photographic materials was assessed in the same manner as in Example 1.

The results are shown in Table 4.

TABLE 4

| Photographic material | Nitrogen-containing heterocyclic compound | ΔD (latent image) | ΔD (with time) | Remarks |
|---|---|---|---|---|
| B - 2 | W - 30 | +0.01 | −0.04 | This |

TABLE 4-continued

| Photo-graphic material | Nitrogen-containing heterocyclic compound | ΔD (latent image) | ΔD (with time) | Remarks |
|---|---|---|---|---|
| | | | | invention |
| B - 9 | None | −0.06 | −0.19[2] | Comparative example |
| B - 10 | IV - 16 | −0.01 | −0.04 | This invention |
| B - 11 | IV - 33 | −0.03 | −0.07 | This invention |

[1]The added amount was the same molar amount as that of the compound (IV - 30).
[2]In sample B - 9, an increase in fog density due to passage of time was also found.

From the results shown in Table 4, in the case of the nitrogen-containing heterocyclic compounds shown in Table 4, the effect of the present invention was confirmed. Further it was found that the effect was particularly remarkable in the case of azoles having a mercapto group, such as mercaptothiazoles and mercaptotetrazoles.

EXAMPLE 4

The procedure for emulsions B-1 or B-2 prepared in Example was repeated, except that thiosulfonic compounds were added as shown in Table 5, after the addition of the red-sensitive sensitizing dye and before the addition of the reduction sensitizer, thereby preparing emulsions, which were then introduced into red-sensitive layers to produce photographic materials B-12 to B-15. The performance of the photographic materials was assessed in the same manner as in Example 1. The results are shown in Table 5.

TABLE 5

| Sample | Red-sensitive sensitizing dye | Thiosulfonic acid compound[1] | S[2] | ΔD (latent image) | ΔD (with time) | Remarks |
|---|---|---|---|---|---|---|
| B - 1 | S - 1 | — | 100 | −0.05 | −0.17 | Comparative example |
| B - 2 | I - 22 | — | 132 | +0.01 | −0.04 | This invention |
| B - 12 | S - 1 | VIII - 16 | 105 | −0.05 | −0.15 | Comparative example |
| B - 13 | I - 22 | VIII - 16 | 170 | +0.01 | −0.01 | This invention |
| B - 14 | I - 22 | VIII - 10 | 162 | +0.01 | −0.01 | " |
| B - 15 | I - 22 | VIII - 2 | 151 | −0.01 | −0.02 | " |

[1]The added amount was $2 \times 10^{-5}$ mol per mol of Ag in all cases.
[2]Relative value are shown by assuming the sensitivity of sample B - 1 to be 100.

As shown in Table 5, it became apparent that the effect of the present invention was further increased by adding thiosulfonic acid compounds to the present silver halide emulsion subjected to reduction sensitization.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide photographic material comprising on its base at least one photosensitive emulsion layer comprising a nitrogen-containing heterocyclic compound and a silver halide emulsion having a silver chloride content of at least 90 mol %, the emulsion having been spectrally sensitized with a red-sensitive sensitizing dye having a reduction potential value of −1.27 V (vs SCE) or a value lower than −1.27 V (vs SCE), and which has been subjected to reduction sensitization wherein the emulsion is produced by the steps of grain formation, desalting, chemical-sensitization, and reduction sensitization which is carried out at the time of grain nuclei formation, at the time of physical ripening of the grains, at the time of growth of the grains, or prior to or after chemical sensitization.

2. The silver halide photographic material as claimed in claim 1, wherein the reduction potential value of red-sensitive sensitizing dye is −1.285 V to −1.60 V (vs SCE).

3. The silver halide photographic material as claimed in claim 1, wherein the red-sensitive sensitizing dye is represented by the following formula (I):

Formula (I)

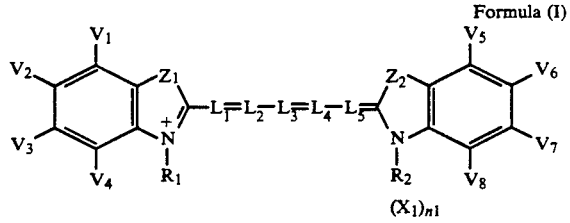

wherein $Z_1$ represents a nitrogen atom, an oxygen atom, a sulfur atom, or a selenium atom, and $Z_2$ represents an oxygen atom, a sulfur atom, or a selenium atom, $L_1$, $L_2$, $L_3$, $L_4$, and $L_5$ each represent a methine group, and they may form a ring together with other methine group, $R_1$ and $R_2$, which may be the same or different, each represent an alkyl group, $R_1$ and $L_1$ may bond together to form a 5- or 6-membered carbon ring and/or $R_2$ and $L_5$ may bond together to form a 5- or 6-membered carbon ring, $V_1$, $V_2$, $V_3$, $V_4$, $V_5$, $V_6$, $V_7$, and $V_8$ each represent a hydrogen atom, a halogen atom, an alkyl group, an acyl group, an acyloxy group, an alkoxycarbonyl group, a carbamoyl group, a sulfamoyl group, a carboxy group, a cyano group, a hydroxyl group, an amino group, an acylamino group, an alkoxy group, an alkoxythio group, an alkylsulfonyl group, a sulfonic acid group, an aryloxy group, or an aryl group, and of $V_1$ to $V_8$, two bonded to adjacent carbon atoms may bond together to form a condensed ring, and $(X_1)_{n1}$ represents a charge balancing counter ion in which n1 represents a value of 0 or greater required to neutralize the charge.

4. The silver halide photographic material as claimed in claim 3, wherein the red-sensitive sensitizing dye represented by formula (I) is a dye represented by the following formula (II):

Formula (II)

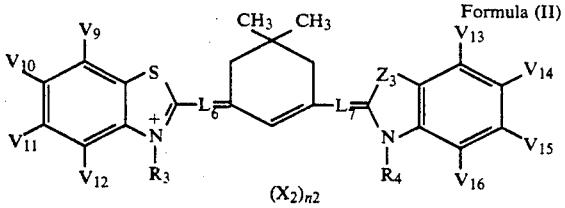

wherein $Z_3$ represents an oxygen atom or a sulfur atom, $L_6$ and $L_7$ each represent a methine group, $R_3$ and $R_4$, which may be the same or different, each represent an alkyl group, $R_3$ and $L_6$ may bond together to form a 5- or 6-membered carbon ring, and $R_4$ and $L_7$ may bond together to form a 5- or 6-membered carbon ring, $V_9$, $V_{10}$, $V_{11}$, $V_{12}$, $V_{13}$, $V_{14}$, $V_{15}$, and $V_{16}$ each represent a hydrogen atom, a halogen atom, an alkyl group, an acyl group, an acyloxy group, an alkoxycarbonyl group, a carbamoyl group, a sulfamoyl group, a carboxy group, a cyano group, a hydroxyl group, an amino group, an acylamino group, an alkoxy group, an alkoxythio group, an alkylsulfonyl group, a sulfonic acid group, an aryloxy group, or an aryl group, out of $V_9$ to $V_{16}$, two bonded to adjacent carbon atoms cannot form a condensed ring, by defining their Hammett $\sigma_p$ values as $\sigma_{pi}$ (i=9 to 16), if $Y_0=\sigma_{p9}+\sigma_{p10}+\sigma_{p11}+\sigma_{p12}+\sigma_{p13}+\sigma_{p14}+\sigma_{p15}+\sigma_{p16}$, then when $Z_3$ is an oxygen atom, $Y_0 \leqq -0.08$, while when $Z_3$ is a sulfur atom, $Y_0 \leqq -0.15$, and $(X_2)_{n2}$ represents a charge balancing counter ion in which n2 represents a value of 0 or greater required to neutralize the charge.

5. The silver halide photographic material as claimed in claim 3, wherein the red-sensitive sensitizing dye represented by formula (I) is a dye represented by the following formula (III):

Formula (III)

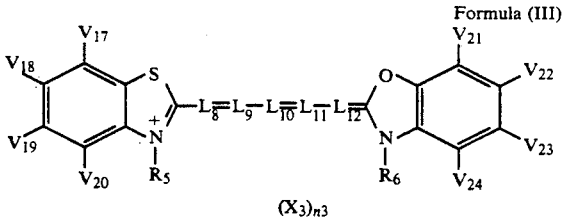

wherein $L_8$, $L_9$, $L_{10}$, $L_{11}$, and $L_{12}$ each represent a methine group, and they may form a ring together with other methine group, $R_5$ and $R_6$, which may be the same or different, each represent an alkyl group, $V_{17}$, $V_{18}$, $V_{19}$, $V_{20}$, $V_{21}$, $V_{22}$, $V_{23}$, and $V_{24}$ each represent a hydrogen atom, a halogen atom, an alkyl group, an acyl group, an acyloxy group, an alkoxycarbonyl group, a carbamoyl group, a sulfamoyl group, a carboxy group, a cyano group, a hydroxyl group, an amino group, an acylamino group, an alkoxy group, an alkoxythio group, an alkylsulfonyl group, a sulfonic acid group, an aryloxy group, or an aryl group, and of $V_{17}$ to $V_{24}$, at least one set of twos bonded to adjacent carbon atoms is bonded together to form a benzene ring or a heterocyclic ring, and $(X_3)_{n3}$ represents a charge balancing counter ion in which n3 represents a value of 0 or greater required to neutralize the charge.

6. The silver halide photographic material as claimed in claim 5, $L_8$, $L_9$, $L_{10}$, $L_{11}$, and $L_{12}$, of formula (III) each represent a methine group substituted by a substituent wherein the Hammett $\sigma_p$ value is negative.

7. The silver halide photographic material as claimed in claim 1, wherein the red-sensitive sensitizing dye is contained $4\times10^{-6}$ to $8\times10^{-3}$ mol per mol of the silver halide of the silver halide emulsion of the layer containing high-silver chloride emulsion.

8. The silver halide photographic material as claimed in claim 1, wherein the nitrogen-containing compound is a compound represented by the following formula (IV):

$$Z-Y \qquad \text{(IV)}$$

wherein

Z represents an azole ring, a pyrimidine ring, a triazine ring, a pyridine ring, or an azaindene ring, and Y represents a hydrogen atom, a substituent, a substituted or unsubstituted alkyl group, an alkenyl group, an aralkyl group, an aryl group, a heterocyclic residue, a halogen atom, a mercapto group, a cyano group, a carboxyl group, a sulfo group, a hydroxyl group, a carbamoyl group, a sulfamoyl group, an amino group, a nitro group, an alkoxy group, an aryloxy group, an acyl group, an acylamino group, a substituted amino, an alkylthio or arylthio group or an aryloxycarbonyl group.

9. The silver halide photographic material as claimed in claim 1, wherein the nitrogen-containing compound is a disulfide represented by following formula (V):

$$Z-S-S-Z \qquad \text{(V)}$$

wherein

Z represents an azole ring, a pyrimidine ring, a triazine ring, a pyridine ring, or an azaindene ring.

10. The silver halide photographic material as claimed in claim 1, wherein the nitrogen-containing compound is a compound having a thioketone group represented by the following formula (VI):

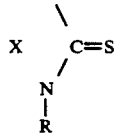

wherein

R represents an alkyl group, an aralkyl group, an alkenyl group, or an aryl group, and X represents a group of atoms required to form a 5- to 6-membered ring, which may be condensed.

11. The silver halide photographic material as claimed in claim 1, wherein the nitrogen-containing heterocyclic compound is a mercaptoazole.

12. The silver halide photographic material as claimed in claim 11, wherein the mercaptoazole is a mercaptothiazole or a mercaptotetrazole.

13. The silver halide photographic material as claimed in claim 1, wherein the nitrogen-containing heterocyclic compound is contained $1\times10^{-5}$ to $4\times10^{-2}$ mol per mol of silver.

14. The silver halide photographic material as claimed in claim 1, wherein the silver halide emulsion has a silver chloride content of 95 mol % or over.

15. The silver halide photographic material as claimed in claim 1, wherein the red-sensitive sensitizing dye is used in combination with a supersensitizing dye.

16. The silver halide photographic material as claimed in claim 1, wherein the photosensitive layer further contains at least one compound selected from the group consisting of compounds represented by the following formulae (VIII), (IX), and (X):

$$R—SO_2S—M \quad \text{(VIII)}$$

$$R—SO_2S—R^1 \quad \text{(IX)}$$

$$RSO_2S—L_m—SO_2S—R^2 \quad \text{(X)}$$

wherein

R, $R^1$, and $R^2$, which may be the same or different, each represent an aliphatic group, an aromatic group, or a heterocyclic group, M represents a cation, L represents a divalent linking group, and m is 0 or 1.

* * * * *

UNITED STATES PATENT AND TRADEMARK OFFICE

CERTIFICATE OF CORRECTION

PATENT NO. : 5,176,993

DATED : January 5, 1993

INVENTOR(S) : Ohshima

It is certified that error appears in the above-identified patent and that said Letters Patent is hereby corrected as shown below:

In column 77, line 20, amend "$V_1 1$" to --$V_{11}$--; and

In column 78, line 55, amend the formula to read:

-- 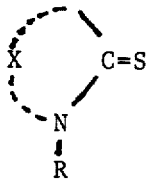 --.

Signed and Sealed this

Twenty-fifth Day of January, 1994

*Attest:*

*Attesting Officer*

BRUCE LEHMAN

*Commissioner of Patents and Trademarks*